US012660965B2

(12) United States Patent
Robertson et al.

(10) Patent No.: US 12,660,965 B2
(45) Date of Patent: Jun. 23, 2026

(54) LOADING DEVICE FOR SHEET PRODUCT DISPENSERS

(71) Applicant: GPCP IP Holdings LLC, Atlanta, GA (US)

(72) Inventors: Timothy Andrew Robertson, Appleton, WI (US); Kyle Andrew Pfeifer, Appleton, WI (US); Antonio Michael Cittadino, Appleton, WI (US)

(73) Assignee: GPCP IP Holdings LLC

( * ) Notice: Subject to any disclaimer, the term of this patent is extended or adjusted under 35 U.S.C. 154(b) by 440 days.

(21) Appl. No.: 18/230,188

(22) Filed: Aug. 4, 2023

(65) Prior Publication Data

US 2024/0041270 A1 Feb. 8, 2024

Related U.S. Application Data

(60) Provisional application No. 63/395,047, filed on Aug. 4, 2022.

(51) Int. Cl.
*A47K 10/36* (2006.01)
*A47K 10/38* (2006.01)

(52) U.S. Cl.
CPC ..... *A47K 10/3687* (2013.01); *A47K 10/38* (2013.01); *A47K 2010/3681* (2013.01)

(58) Field of Classification Search
CPC ..... A24K 10/3687; A47K 10/38; A47K 2010/3681
USPC ..... 221/10
See application file for complete search history.

(56) References Cited

U.S. PATENT DOCUMENTS 3,007,650 A * 11/1961 Burton ..... A47K 10/36 312/34.19
3,050,224 A * 8/1962 Drolshammer ..... A47K 10/38 225/88
3,126,234 A * 3/1964 Batlas ..... A47K 10/32 242/596.7
3,276,706 A * 10/1966 House ..... A47K 10/38 226/110
3,288,387 A * 11/1966 Craven, Jr. ..... A47K 10/3687 242/560.1
3,628,743 A * 12/1971 Bastian ..... A47K 10/32 242/560.1

(Continued)

FOREIGN PATENT DOCUMENTS

CA 2039382 C 1/1999
CA 2358059 C 5/2004

(Continued)

*Primary Examiner* — Rakesh Kumar

(57) ABSTRACT

An example sheet product dispenser includes a housing for holding a new roll and a previously installed roll of sheet product. The dispenser includes a dispensing mechanism defining a nip and operable to dispense sheet product from either roll for retrieval by the user. A loading device of the dispenser is configured to receive a leading end of a new roll of sheet product being installed into the housing. The loading device can transition between three positions. In a receiving position, the loading device receives the leading end. In a nip loading position, the loading device causes the leading end to enter the nip to cause the dispensing mechanism to begin dispensing from the new roll. In a holding position, the loading device holds the leading end away from the nip to prevent dispensing from the new roll.

24 Claims, 27 Drawing Sheets

(56) References Cited

U.S. PATENT DOCUMENTS 3,917,191 A * 11/1975 Graham, Jr. ..... A47K 10/36 242/596.4
4,010,909 A * 3/1977 Bastian ..... A47K 10/3687 226/91
4,067,509 A * 1/1978 Graham, Jr. ..... A47K 10/36 242/560.1
4,137,805 A * 2/1979 DeLuca ..... A47K 10/3687 226/110
4,165,138 A * 8/1979 Hedge ..... A47K 10/3656 242/564.4
4,264,403 A * 4/1981 Emmel ..... B65C 11/00 156/154
4,307,638 A * 12/1981 DeLuca ..... A47K 10/3643 83/345
4,317,547 A * 3/1982 Graham, Jr. ..... A47K 10/3687 242/560.1
4,358,169 A * 11/1982 Filipowicz ..... A47K 10/3637 225/8
4,367,666 A * 1/1983 Toth ..... B65H 35/08 83/272
4,378,912 A * 4/1983 Perrin ..... A47K 10/3637 226/91
4,403,748 A * 9/1983 Cornell ..... A47K 10/3687 226/129
4,487,375 A * 12/1984 Rasmussen ..... A47K 10/40 226/174
4,552,315 A * 11/1985 Granger ..... A47K 10/3643 242/560.3
4,611,768 A * 9/1986 Voss ..... A47K 10/36 242/564.2
4,691,503 A * 9/1987 Frerich ..... B65B 41/12 53/118
4,756,485 A * 7/1988 Bastian ..... A47K 10/3687 242/560.1
4,807,824 A * 2/1989 Gains ..... A47K 10/3687 242/560.1
4,846,412 A * 7/1989 Morand ..... A47K 10/3687 225/106
5,083,765 A * 1/1992 Kringel ..... B65H 3/5238 271/118
5,161,723 A * 11/1992 Wirtz-Odenthal ..... A47K 10/3687 225/14
5,207,349 A * 5/1993 Kringel ..... B65H 3/52 271/265.01
5,244,161 A * 9/1993 Wirtz-Odenthal ..... A47K 10/3687 242/563.2
5,271,574 A * 12/1993 Formon ..... A47K 10/36 242/560.3
5,294,192 A * 3/1994 Omdoll ..... A47K 10/3687 242/564.4
5,302,167 A * 4/1994 Kley ..... B31F 1/07 493/400
5,375,785 A 12/1994 Boone et al.
5,400,982 A * 3/1995 Collins ..... A47K 10/36 242/564.4
5,441,189 A 8/1995 Formon
5,604,992 A * 2/1997 Robinson ..... A47K 10/485 242/560
5,924,617 A * 7/1999 LaCount ..... A47K 10/36 242/564.2
5,954,256 A * 9/1999 Niada ..... A47K 10/3836 242/598.6
6,105,954 A * 8/2000 Magee ..... B65H 3/5215 271/902
6,145,779 A * 11/2000 Johnson ..... A47K 10/3687 242/564.2
6,152,397 A * 11/2000 Purcell ..... A47K 10/3687 242/563.2
6,224,010 B1 * 5/2001 Morand ..... A47K 10/3687 242/564.2
6,354,533 B1 * 3/2002 Jespersen ..... A47K 10/36 242/564.4
6,356,735 B1 * 3/2002 Hozumi ..... B65H 9/166 271/228
6,460,798 B1 10/2002 Haen et al.
6,616,088 B2 * 9/2003 Lintelmann ..... B65H 19/1852 242/551
6,736,348 B1 * 5/2004 Formon ..... A47K 10/3687 242/563
6,826,985 B2 * 12/2004 Broehl ..... B65H 35/08 83/13
6,826,991 B1 12/2004 Rasmussen
6,830,210 B2 12/2004 Formon et al.
6,871,815 B2 3/2005 Moody
7,114,677 B2 10/2006 Formon et al.
7,237,744 B2 7/2007 Morris
7,270,292 B2 9/2007 Rasmussen
7,341,170 B2 3/2008 Boone
7,354,015 B2 * 4/2008 Byrd ..... A47K 10/36 242/563
7,832,678 B2 11/2010 Hjort
7,841,556 B2 * 11/2010 Elliott ..... A47K 10/3687 242/564.2
7,845,593 B2 12/2010 Formon et al.
7,861,964 B2 1/2011 Cittadino et al.
7,874,509 B2 * 1/2011 Kenney ..... B26F 3/002 242/563.2
7,878,444 B2 * 2/2011 Friesen ..... A47K 10/3687 242/561
7,887,005 B2 2/2011 Troutman et al.
8,162,252 B2 4/2012 Cittadino et al.
8,282,033 B2 * 10/2012 Achton ..... A47K 10/3687 242/560.1
8,448,890 B2 5/2013 Hagleitner
8,616,489 B2 12/2013 Goeking et al.
8,632,030 B2 1/2014 Troutman et al.
8,777,149 B2 7/2014 Goeking et al.
8,800,415 B2 * 8/2014 Osborne ..... A47K 10/3618 83/369
8,910,898 B2 12/2014 Hagleitner
8,960,588 B2 * 2/2015 Byrd ..... A47K 10/3687 242/598.6
9,474,422 B1 10/2016 Troutman et al.
9,604,811 B2 3/2017 Case
9,642,503 B1 5/2017 Troutman et al.
9,681,783 B2 6/2017 Goeking et al.
9,701,508 B2 7/2017 Diamond
9,839,333 B2 12/2017 Goeking et al.
9,999,326 B2 6/2018 Borke et al.
10,159,389 B2 * 12/2018 Goeking ..... A47K 10/26
10,299,638 B2 5/2019 Henson et al.
10,383,489 B2 * 8/2019 Case ..... B65H 45/142
10,470,622 B2 11/2019 Goeking et al.
10,835,086 B2 * 11/2020 Osborne, Jr. ..... A47K 10/3687
11,089,920 B2 8/2021 Trampolski
11,141,027 B2 10/2021 Starkey
11,297,984 B2 * 4/2022 Case ..... B65H 33/18
2001/0017309 A1 * 8/2001 Formon ..... A47K 10/36 225/10
2002/0073821 A1 6/2002 Broehl
2002/0181805 A1 * 12/2002 Loeb ..... H04N 1/3877 382/317
2006/0032862 A1 * 2/2006 Miller ..... B67D 7/22 222/64
2006/0236836 A1 * 10/2006 Cassia ..... A47K 10/3643 83/649
2007/0010389 A1 * 1/2007 Cutrona ..... A47K 10/3643 83/337
2007/0108284 A1 * 5/2007 Pankow ..... G06K 7/10851 235/462.21
2007/0221777 A1 * 9/2007 Valot ..... A47K 10/36 242/564.2
2008/0118235 A1 * 5/2008 Bruno ..... H02K 7/102 188/137

(56) References Cited

U.S. PATENT DOCUMENTS

2009/0057478 A1* 3/2009 Conner ..... A47K 10/36 242/564
2010/0044407 A1* 2/2010 Yardley ..... B65H 35/0006 225/14
2010/0219284 A1* 9/2010 Troutman ..... A47K 10/36 242/564.4
2010/0314820 A1* 12/2010 Ko ..... B65H 37/00 101/45
2011/0114782 A1* 5/2011 Rodrian ..... A47K 10/36 700/243
2011/0148258 A1* 6/2011 Tanaka ..... H02K 23/66 310/68 B
2012/0111979 A1* 5/2012 Jensen ..... B02C 18/142 241/36
2012/0235351 A1* 9/2012 Sakoguchi ..... B65H 83/02 271/265.01
2013/0099924 A1* 4/2013 Larsson ..... G08B 21/182 428/411.1
2015/0196174 A1* 7/2015 Goltz ..... B65D 83/0805 242/596
2015/0238056 A1* 8/2015 Fellhoelter ..... A47K 10/3687 242/560
2019/0104895 A1* 4/2019 Johnson ..... A47K 10/3687
2020/0205621 A1* 7/2020 Osborne, Jr. ..... A47K 10/36
2020/0390295 A1 12/2020 Osborne, Jr.
2022/0000322 A1 1/2022 Trampolski

FOREIGN PATENT DOCUMENTS

CA 3009987 A1 7/2017
CA 2760805 C 9/2017
CA 3095612 A1 10/2019
CA 3099743 A1 11/2019
CA 3142926 A1 12/2020
EP 0099602 A1 2/1984
MX 2008016217 A 1/2009
MX 2018008379 A 1/2019
WO 2020251841 A1 12/2020

* cited by examiner

LOADING DEVICE FOR SHEET PRODUCT DISPENSERS

RELATED APPLICATIONS

This application claims priority to U.S. Provisional Application No. 63/395,047, entitled "Loading Device for Sheet Product Dispensers", filed Aug. 4, 2022; the contents of which is hereby incorporated by reference in its entirety.

TECHNICAL FIELD

Example embodiments of the present invention generally relate to sheet product dispensers and, more particularly to, a loading device for improved loading and dispensing for sheet product from a sheet product dispenser.

BACKGROUND

On-demand sheet product (e.g., paper towel, tissue, napkin, etc.) dispensers are useful in many environments. Component cost and general size constraints (e.g., for placement of the dispenser within the environment) are factors that are important for sheet product dispensers. Cost considerations include using the entirety of the sheet product from one or more installed rolls of sheet product while also providing for reduced and accurate maintainer interaction with the sheet product dispenser.

Many sheet product dispensers utilize a two-roll system, where one roll may be partially used (e.g., a "stub roll") and a second roll may be a new roll. In cases where there is only a single dispensing mechanism, a transfer mechanism may be provided, where a leading end of a second roll of sheet product (often a "full" roll of sheet product) is positioned therein. When a sufficient amount of sheet product is dispensed from the stub roll (which is currently being dispensed from), the transfer mechanism inserts the leading end of the second roll of sheet product into the dispensing mechanism automatically to cause continuous dispensing from the sheet product dispenser without user or maintainer interaction.

When a maintainer replenishes the sheet product in such an example dispenser with a transfer mechanism (e.g., inserts a new replacement roll of sheet product), there are two places to load the leading end of the new sheet product depending on the status of the product dispenser—either into the transfer mechanism or directly into the dispensing nip. This causes confusion, and in some instances, leads to incorrect placement of the leading end of the sheet product, which can cause waste and/or jamming to occur.

SUMMARY

Various example embodiments of the present invention described herein provide improvements related to such factors and features for sheet product dispensers.

In some example embodiments, an improved structure for loading sheet product is provided. Example sheet product dispensers provide for intuitive loading of replacement rolls, while allowing the sheet product dispenser to dispense all of the sheet product contained on the sheet product rolls. In some embodiments, double sheeting (e.g., when sheet product from more than one roll is dispensed in the same dispensing event) can be avoided, which often occurs with transfer mechanisms.

Accordingly, various embodiments of the present invention provide a loading device for receiving a leading end of the sheet product. When a maintainer opens the sheet product dispenser, the maintainer will always position the leading end of a replacement roll of sheet product into the loading device—no matter the status of the rolls in the sheet product dispenser (e.g., whether a secondary or stub roll is being dispensed from or not). Thus, rather than having different places to load a leading end of the sheet product (e.g., a transfer mechanism or the dispensing mechanism) depending on the status of the sheet product rolls (e.g., full, partially full and/or empty) and/or whether or not there is a sheet product roll already installed within the housing, the maintainer will always load the sheet product into the loading device, thereby providing a simple routine for the maintainer to reduce maintainer confusion and wasted product. Further, in some embodiments, the loading device may also transition right away into the appropriate position to provide immediate user feedback to help the maintainer know that they successfully loaded the sheet product dispenser.

In some embodiments, a sheet product dispenser for dispensing sheet product is provided. The sheet product dispenser comprises a housing. The housing is configured to hold a new roll of sheet product and a previously installed roll of sheet product. The sheet product dispenser further comprises a dispensing mechanism defining a nip. The nip receives sheet product from one of the new roll or the previously installed roll therethrough. The dispensing mechanism is operable to dispense the sheet product from the one of the new roll or the previously installed roll to provide a dispensed portion of sheet product for retrieval by a user. The sheet product dispenser further comprises a loading device. The loading device receives a leading end of the new roll of sheet product being installed into the housing. The loading device is configured to transition between a nip loading position, a receiving position, and a holding position. In the receiving position, the loading device is configured to cause the leading end of the new roll of sheet product. In the nip loading position, the loading device is configured to cause the leading end of the new roll of sheet product to enter the nip of the dispensing mechanism to cause the dispensing mechanism to begin dispensing sheet product from the new roll of sheet product. In the holding position, the loading device is configured to hold the leading end of the new roll of sheet product in a position away from the nip of the dispensing mechanism such that the dispensing mechanism does not dispense sheet product from the new roll of sheet product.

In some embodiments, the sheet product dispenser may further comprise a sensor configured to sense whether or not sheet product is present in a dispensing chute that is positioned downstream of the nip. In some embodiments, the sheet product dispenser may further comprise a controller configured to determine, based on data from the sensor, whether sheet product is present in the dispensing chute. The controller may cause the loading device to transition to the holding position if there is sheet product present in the dispensing chute. The controller may cause the loading device to transition to the nip loading position, if there is not sheet product present in the dispensing chute.

In some embodiments, the controller may be configured to cause the loading device to transition back to the receiving position after the loading device has transitioned to the nip loading position.

In some embodiments, the sheet product dispenser may further comprise a loading sensor. The loading sensor may be configured to sense when the leading end of the new roll of sheet product is received by the loading device. The controller may be configured to determine, based on data from the loading sensor, an instance in which the loading device has received the leading end of the new roll of sheet product and, in response, determine whether the sheet product is present in the dispensing chute. In some embodiments, the controller may cause the loading device to transition to the holding position if there is sheet product present in the dispensing chute. In some embodiments, the controller may cause the loading device to transition to the nip loading position if there is not sheet product present in the dispensing chute.

In some embodiments, the housing may include a base position and a cover. In some embodiments, the cover may be configured to transition between an open position and a closed position. The sheet product dispenser may further comprise a cover sensor configured to sense when the cover transitions to the closed position. In some embodiments, the controller is configured to determine, based on data from the cover sensor, an instance in which the cover transitions to the closed position. In some embodiments, the controller may cause the loading device to transition to the holding position if there is sheet product present in the dispensing chute. In some embodiments, the controller may cause the loading device to transition to the nip loading position if there is not sheet product present in the dispensing chute.

In some embodiments, the loading device may be configured to transition between the nip loading position, the receiving position, and the holding position via rotation. In some embodiments, the loading device may define a roller. In some embodiments, the loading device is configured to receive the leading end of the new sheet product roll through a slot within the roller.

In some embodiments, the loading device may be configured to transition from the receiving position to the nip loading position via rotation in a first rotational direction, and transition from the receiving position the holding position via rotation in a second rotational direction that is opposite the first rotational direction.

In some embodiments, in the holding position the loading device may be configured to pinch the leading end of the new sheet product roll against a surface to hold the leading end in place.

In some embodiments, the loading device comprises a body, a flap, and a nip roller. The nip roller is attached to and rotatable with the body. In the receiving position, the flap and the nip roller are spaced apart. In the nip loading position, the flap and the nip roller are adjacent so as to form a loading device nip that holds the leading end of the sheet product such that the leading end of the sheet product enters the nip of the dispensing mechanism.

In some embodiments, the loading device may be configured to transition between the nip loading position, the receiving position, and the holding position, via linear motion.

In some embodiments, the sheet product dispenser may further comprise a motor operable to transition the loading device between the nip loading position, the receiving position and the holding position.

In some embodiments, the sheet product dispenser may further comprise a nip blocker that prevents the loading of the leading end of the new roll of sheet product into the nip. In some embodiments, the nip blocker may transition to an unblocking position to enable the loading device to load the leading end of the new roll of sheet product into the nip when the loading device transitions to the nip loading position.

In another example embodiment, a chassis for a sheet product dispenser for dispensing sheet product is provided. The sheet product dispenser includes a housing configured to hold a first roll of sheet product and a second roll of sheet product. The chassis comprises a dispensing mechanism defining a nip. The nip is configured to receive sheet product from one of the new roll or the previously installed roll therethrough. The dispensing mechanism is operable to dispense the sheet product from the one of the new roll or the previously installed roll to provide a dispensed portion of sheet product for retrieval by a user. The chassis further comprises a loading device. The loading device is configured to receive a leading end of the new roll of sheet product being installed into the housing. The loading device is configured to transition between a nip loading position, a receiving position, and a holding position. In the receiving position, the loading device is configured to receive the leading end of the new roll of sheet product. In the nip loading position, the loading device is configured to cause the leading end of the new roll of sheet product to enter the nip of the dispensing mechanism to cause the dispensing mechanism to begin dispensing sheet product from the new roll of sheet product. In the holding position, the loading device is configured to hold the leading end of the new roll of sheet product in a position away from the nip of the dispensing mechanism such that the dispensing mechanism does not dispense sheet product from the new roll of sheet product.

In some embodiments, the sheet product dispenser may further comprise a sensor configured to sense whether or not sheet product is present in a dispensing chute that is positioned downstream of the nip. In some embodiments, the sheet product dispenser may further comprise a controller configured to determine, based on data from the sensor, whether sheet product is present in the dispensing chute. The controller may cause the loading device to transition to the holding position if there is sheet product present in the dispensing chute. The controller may cause the loading device to transition to the nip loading position, if there is not sheet product present in the dispensing chute.

In some embodiments, the loading device may be configured to transition between the nip loading position, the receiving position and the holding position via rotation. In some embodiments, the loading device may be configured to transition between the nip loading position, the receiving position, and the holding position via linear motion.

In yet another example embodiment of the present invention, a method for controlling loading of a leading end of a new roll of sheet product into a nip of a dispensing mechanism of a sheet product dispenser is provided. The sheet product dispenser of the method includes a housing configured to hold a new roll of sheet product and a previously installed roll of sheet product. The sheet product dispenser further comprises a loading device configured to receive the leading end of the new roll of sheet product being installed into the housing or the leading end of the previously installed roll. The loading device is configured to transition between a nip loading position, the receiving position, and the holding position. In the receiving position, the loading device is configured to receive the leading end of the new roll of sheet product. In the nip loading position, the loading device is configured to cause the leading end of the new roll of sheet product to enter the nip of the dispensing mechanism to cause the dispensing mechanism to begin dispensing sheet product from the new roll of sheet product. In the holding position, the loading device is configured to hold the leading end of the new roll of sheet product in a position away from the nip of the dispensing mechanism such that the dispensing mechanism does not dispense sheet product from the new roll of sheet product. The method comprises receiving data from a sensor configured to sense whether or not sheet product is present in a dispensing chute that is positioned downstream of the nip. The method further comprises determining, via a controller and based on data from the sensor, whether the sheet product is present in the dispensing chute. The method comprises causing the loading device to transition to a holding position from a receiving position if the sheet product is present in the dispensing chute or causing the loading device to transition to the nip loading position if the sheet product is not present in the dispensing chute.

In some embodiments, the method may further comprise causing the loading device to transition back to the receiving position after the loading device had transitioned to the nip loading position.

In some embodiments, the sheet product dispenser may further comprise a loading sensor. The loading sensor may be configured to sense when the leading end of the new roll of sheet product is received by the loading device. The method may further comprise determining, based on data from the loading sensor, an instance in which leading end is received by the loading device and, in response, determining whether the sheet product is present in the dispensing chute. The method may continue by causing the loading device to transition to the holding position if the sheet product is present in the dispensing chute, or causing the loading device to transition to the nip loading position if the sheet product is not present in the dispensing chute.

In some embodiments, the housing may include a base portion and a cover. The cover may be configured to transition between an open position and a closed position. In some embodiments, the sheet product dispenser may further comprise a cover sensor configured to sense when the cover transitions to the closed position. The method may further comprise determining, based on data from the cover sensor, an instance in which the cover transitions to the closed position and, in response, determining whether the sheet product is present in the dispensing chute. The method may continue by causing the loading device to transition to the holding position if the sheet product is present in the dispensing chute, or causing the loading device to transition to the nip loading position if the sheet product is not present in the dispensing chute.

In yet another embodiment, a sheet product dispenser for dispensing sheet product is provided. The sheet product dispenser comprises a housing configured to hold a new roll of sheet product and a previously installed roll of sheet product. The sheet product dispenser further includes a dispensing mechanism defining a nip that receives sheet product from one of the new roll or the previously installed roll therethrough. The dispensing mechanism being operable to dispense the sheet product from the one of the new roll or the previously installed roll to provide a dispensed portion of sheet product for retrieval by a user. The sheet product dispenser further comprises a loading device that receives a leading end of the new roll of sheet product being installed into the housing. The loading device is configured to transition between a nip loading position and a receiving position. The sheet product dispenser further comprises a nip blocker that prevents loading of the leading end of the new roll of sheet product into the nip. In the receiving position, the loading device is configured to receive the leading end of the new roll of sheet product. In the nip loading position, the loading device is configured to cause the leading end of the new roll of sheet product to enter the nip of the dispending mechanism to cause the dispending mechanism to begin dispensing sheet product from the new roll of sheet product.

In some embodiments, the nip blocker may be a flap. The flap may extend from the loading device to cover the nip to prevent loading of the leading end of the new roll of sheet product into the nip. In some embodiments, the loading device may be a roller and the flap may extend from the roller and transition from a blocked position to an unblocked position via rotation of the roller.

BRIEF DESCRIPTION OF DRAWINGS

Figure 1:
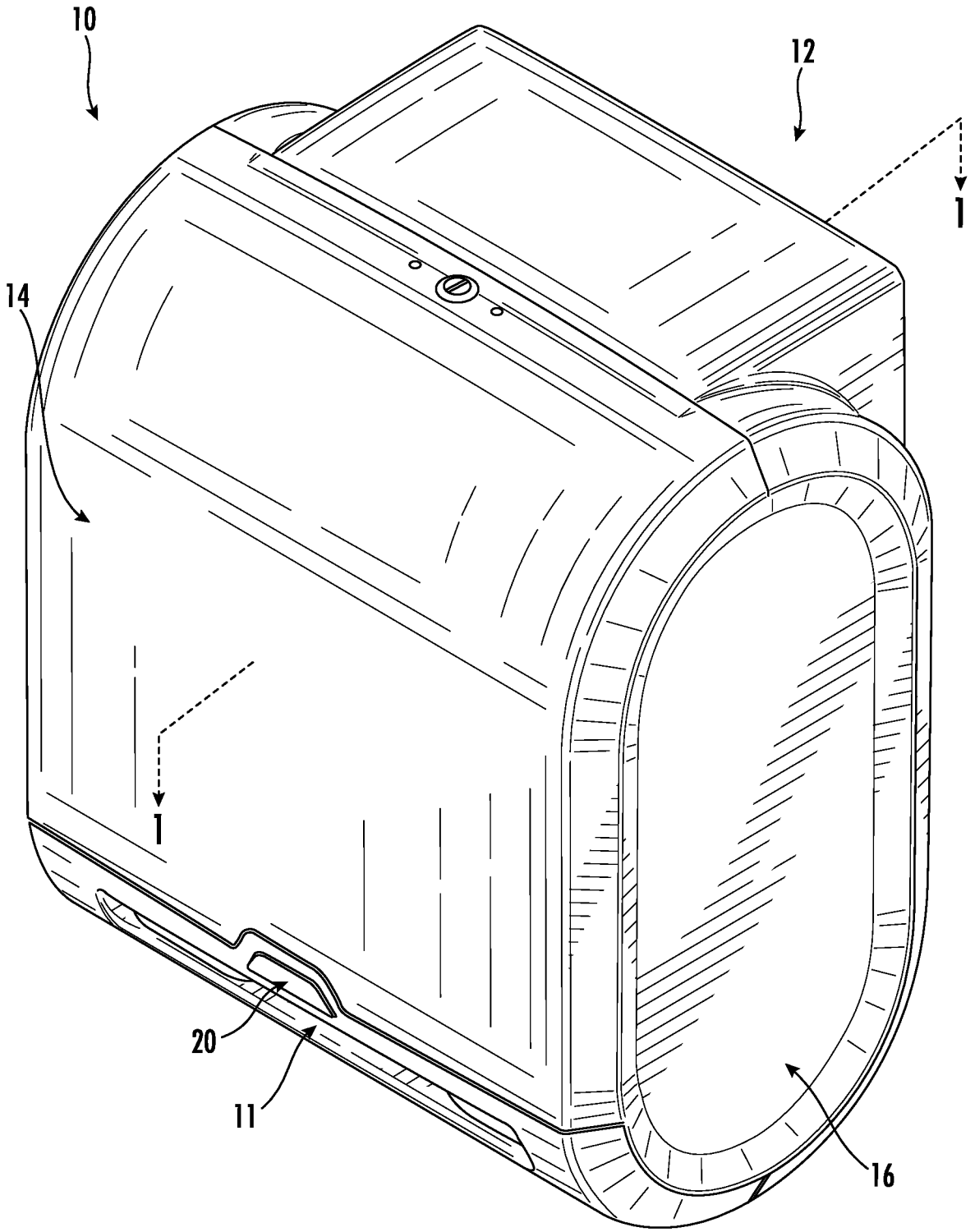
Figure 2:
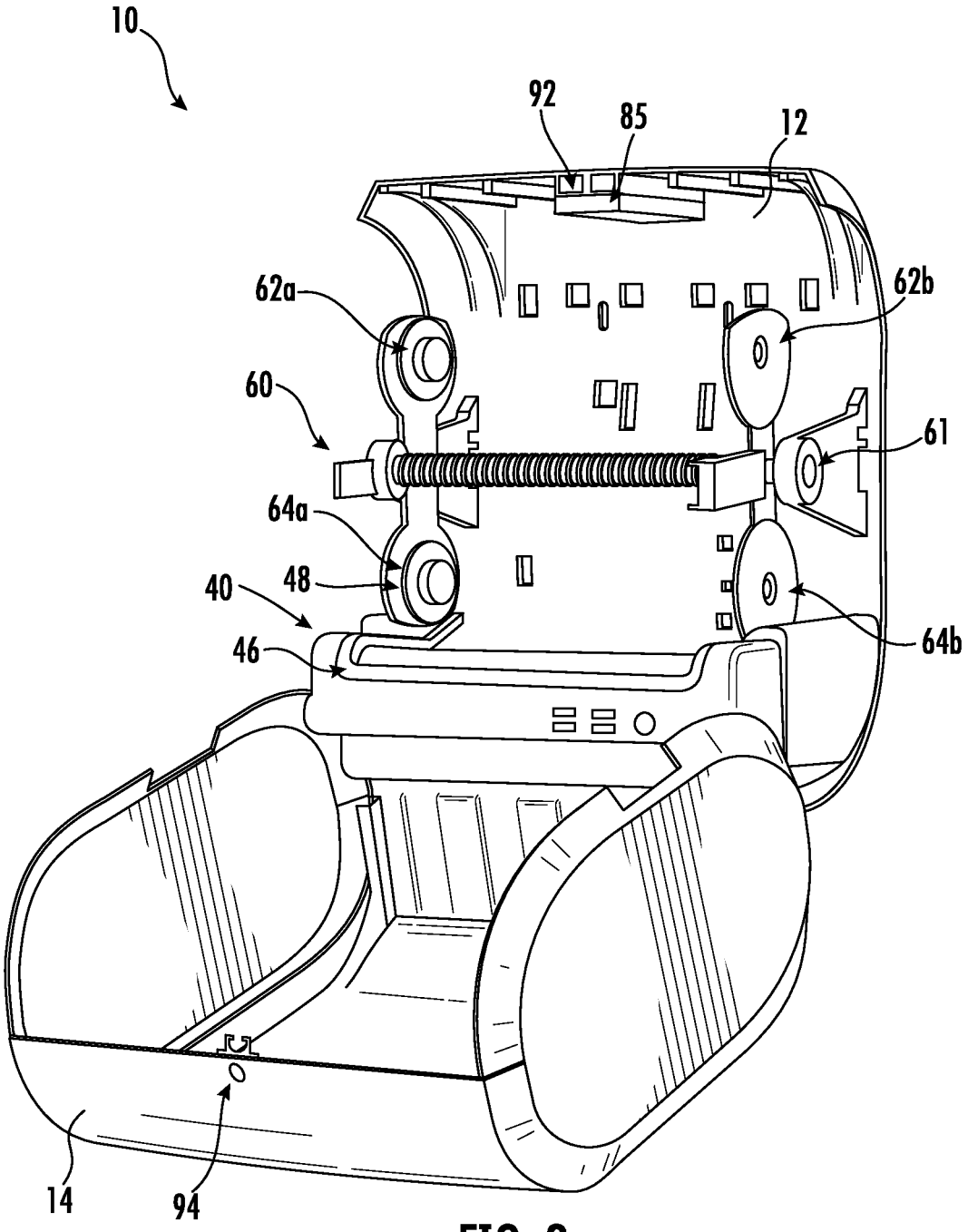
Figure 3A:
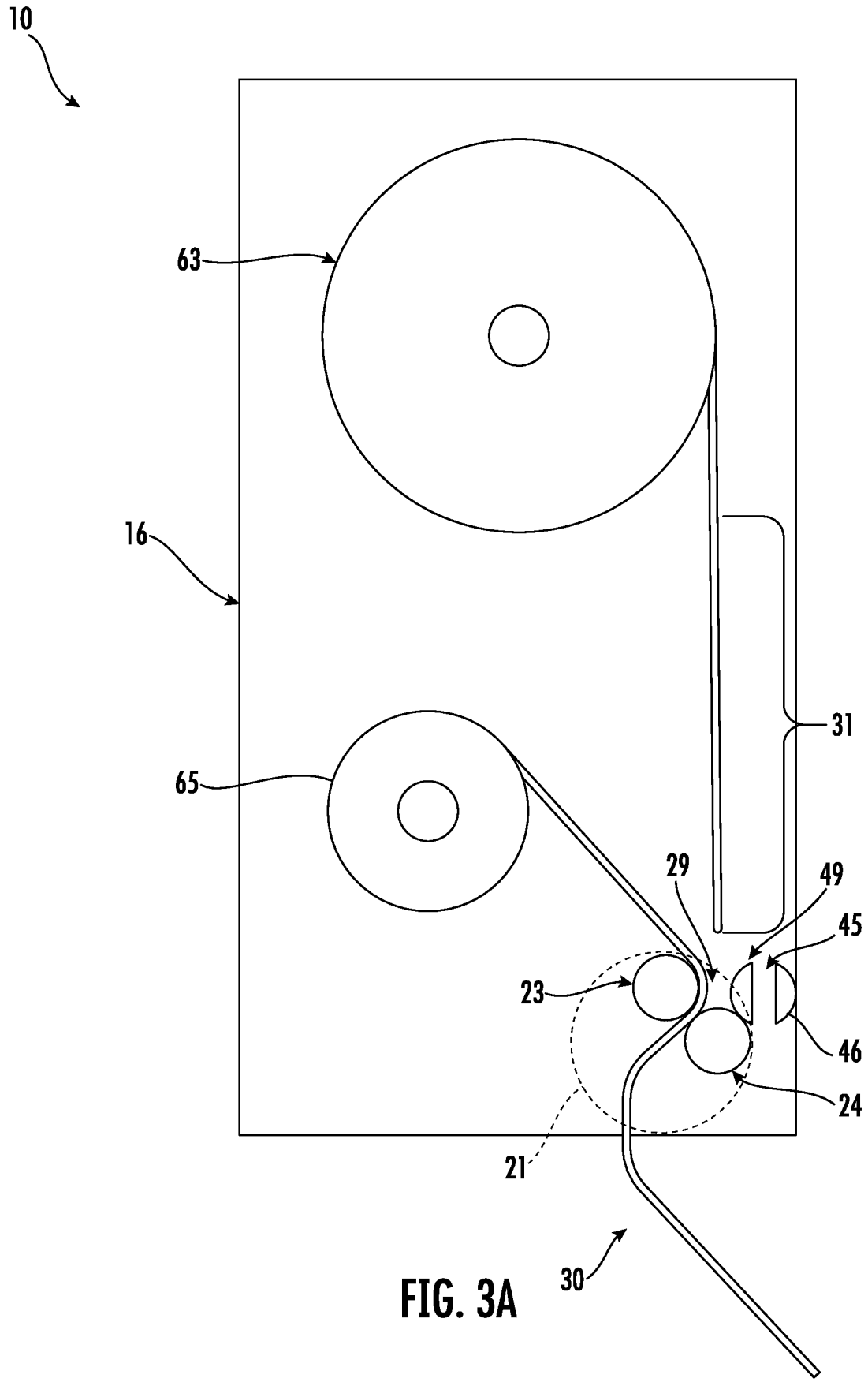
Figure 3B:
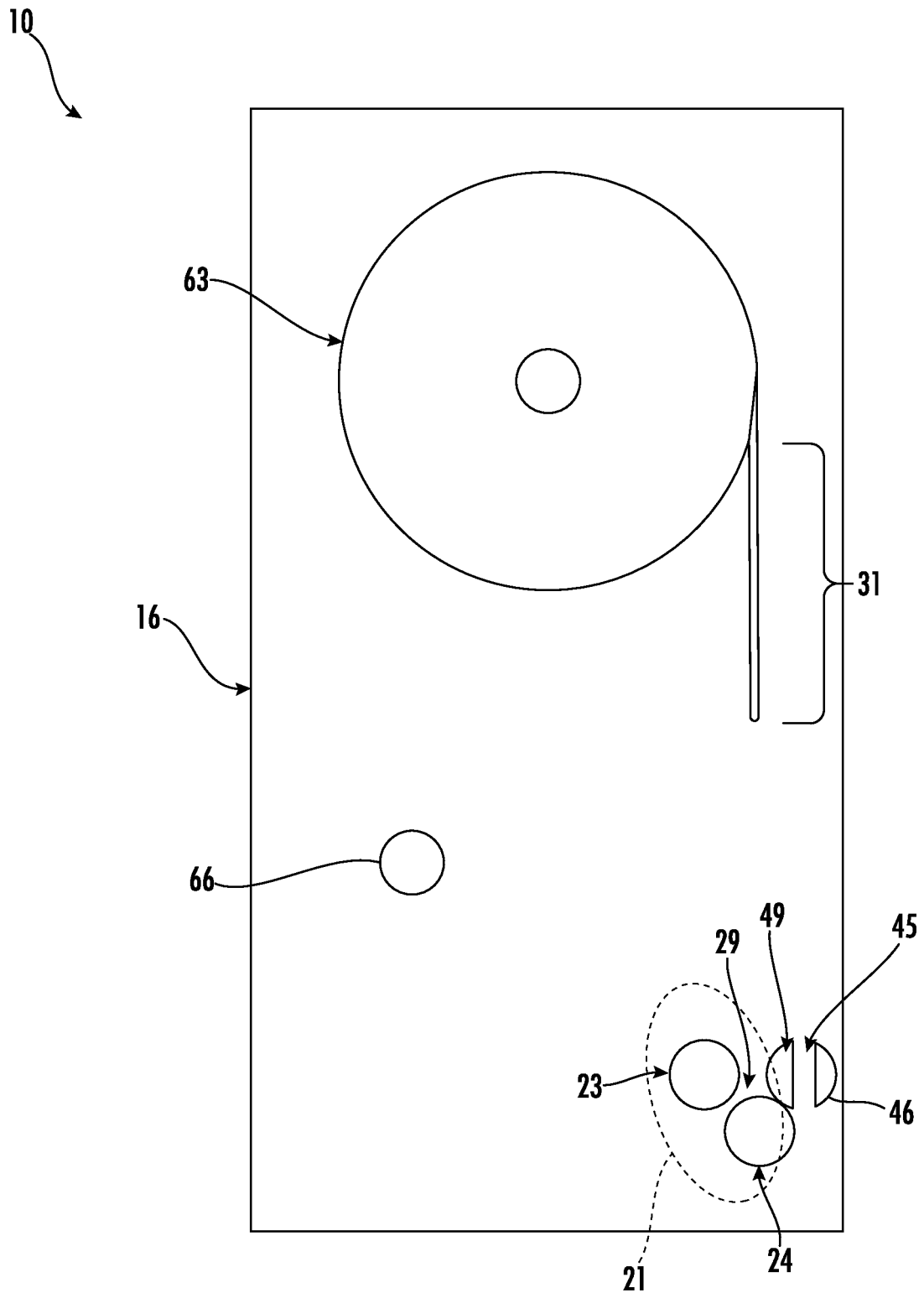
Figure 4:
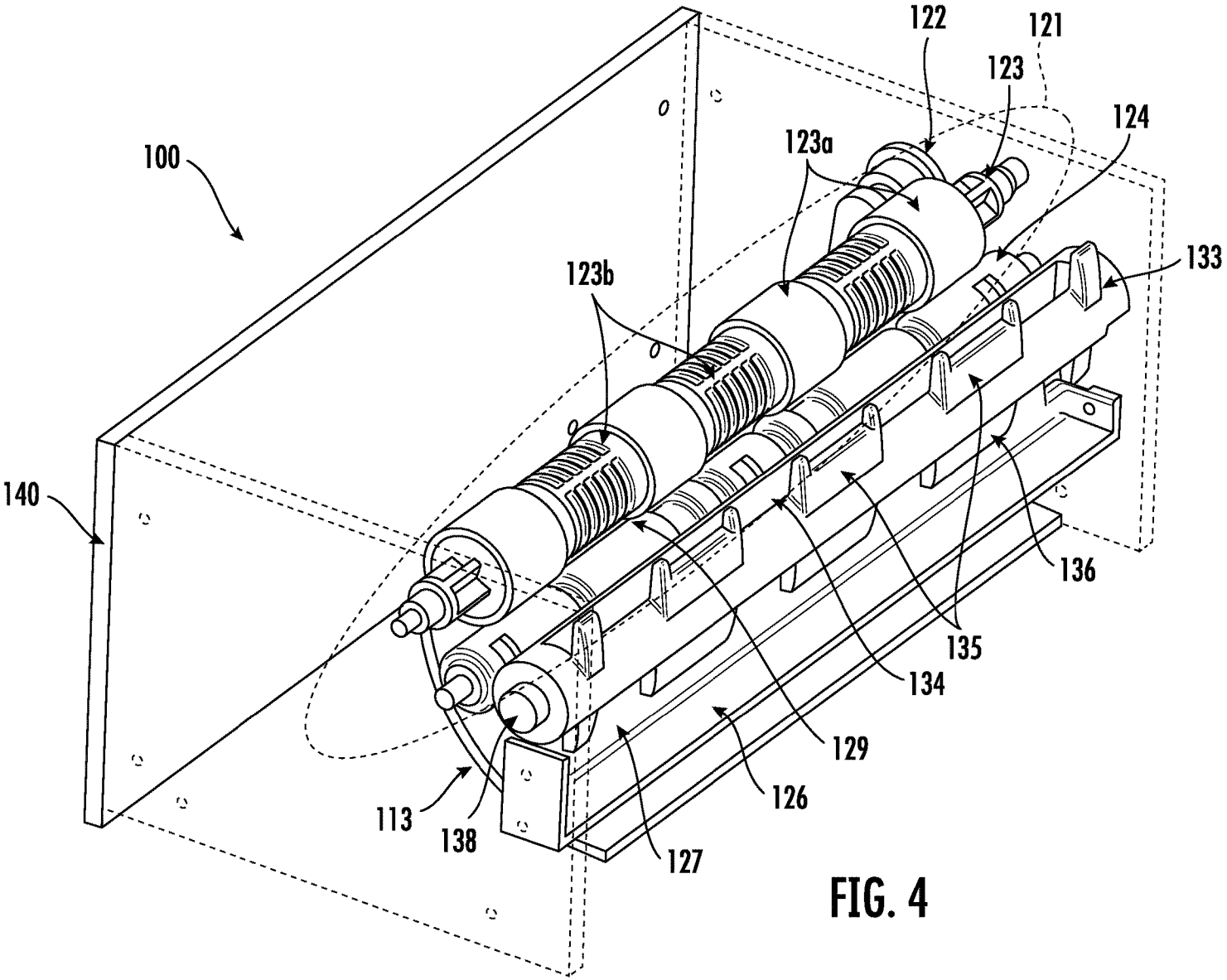
Figure 5:
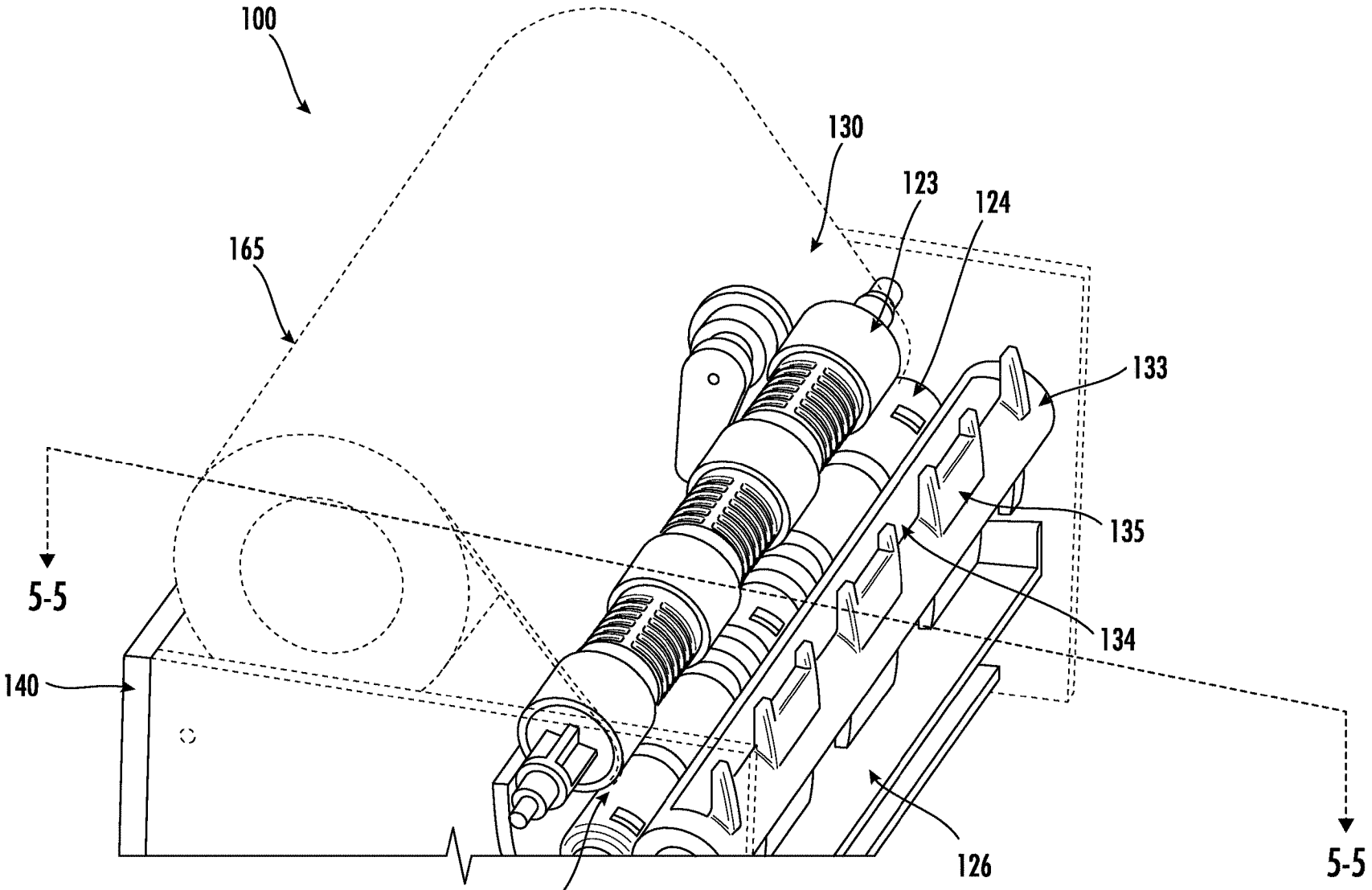
Figure 6:
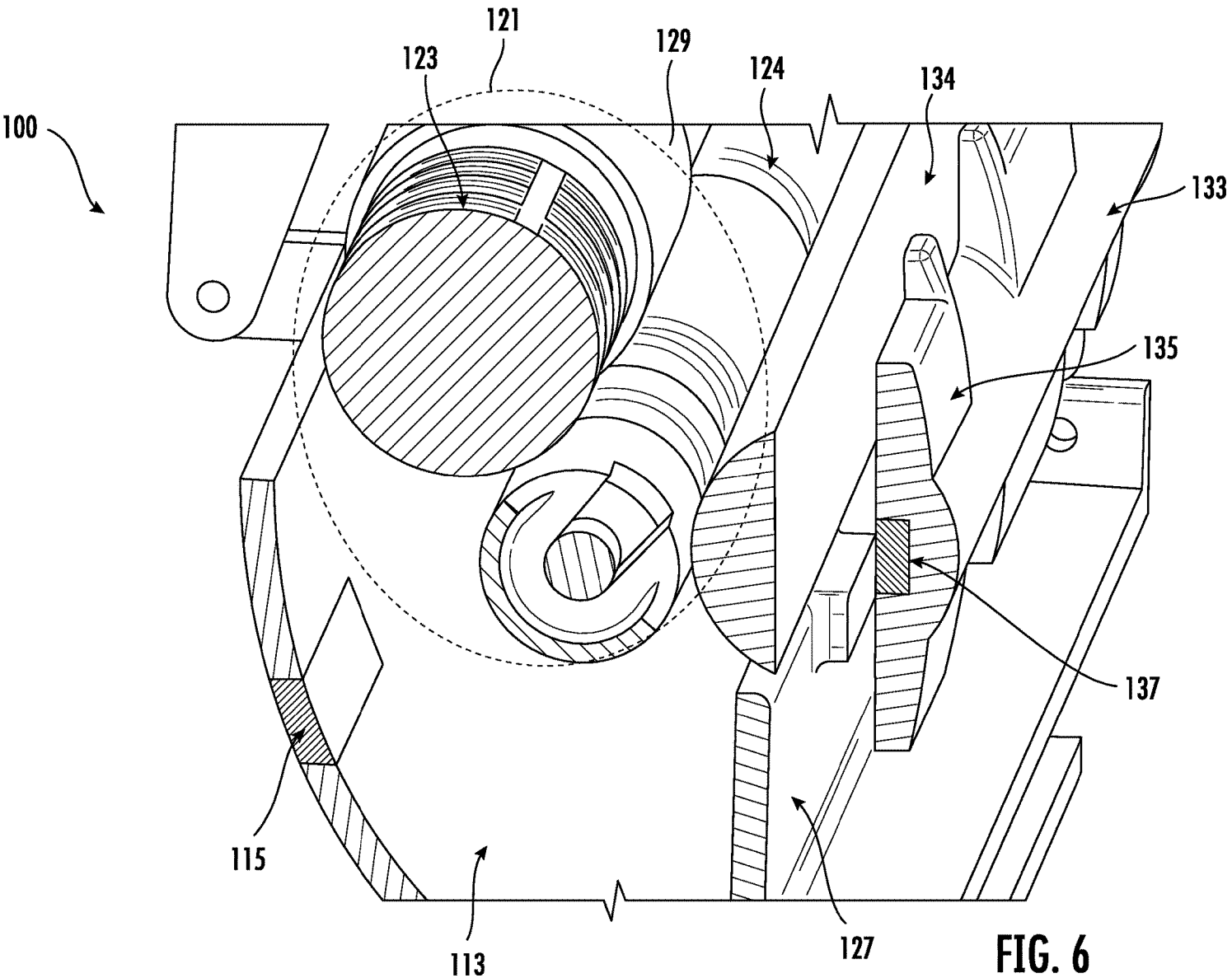
Figure 7:
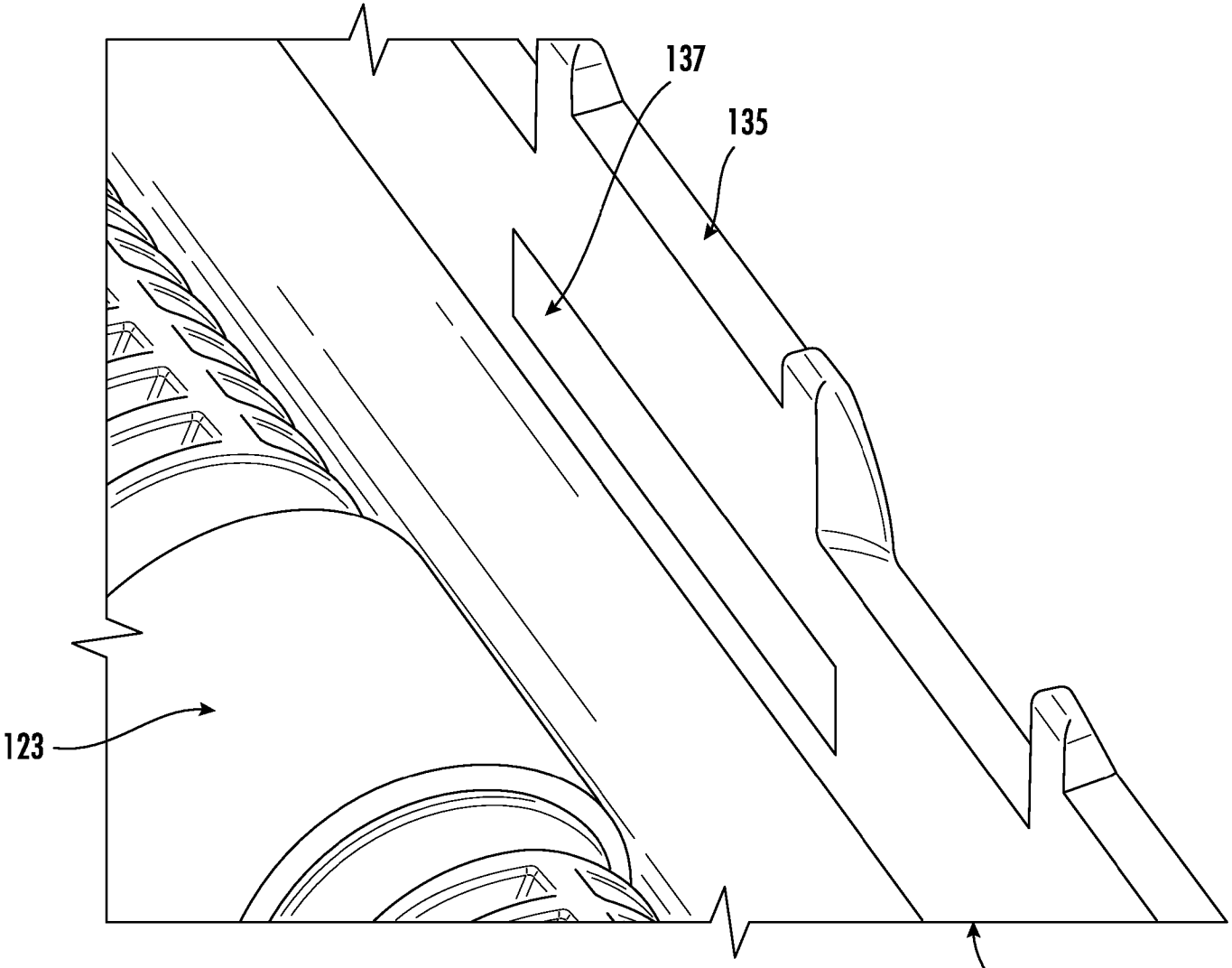
Figure 8:
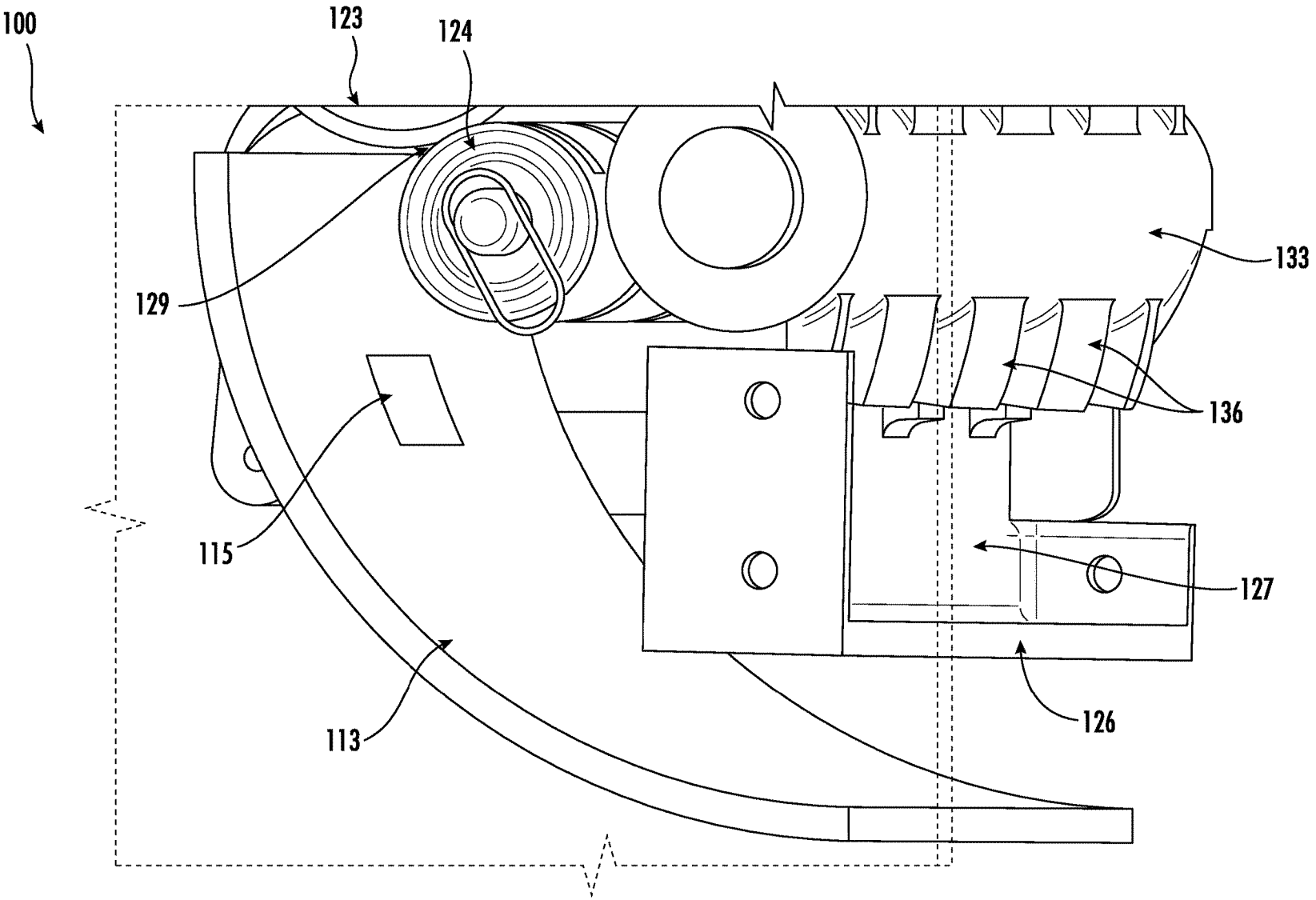
Figure 9A:
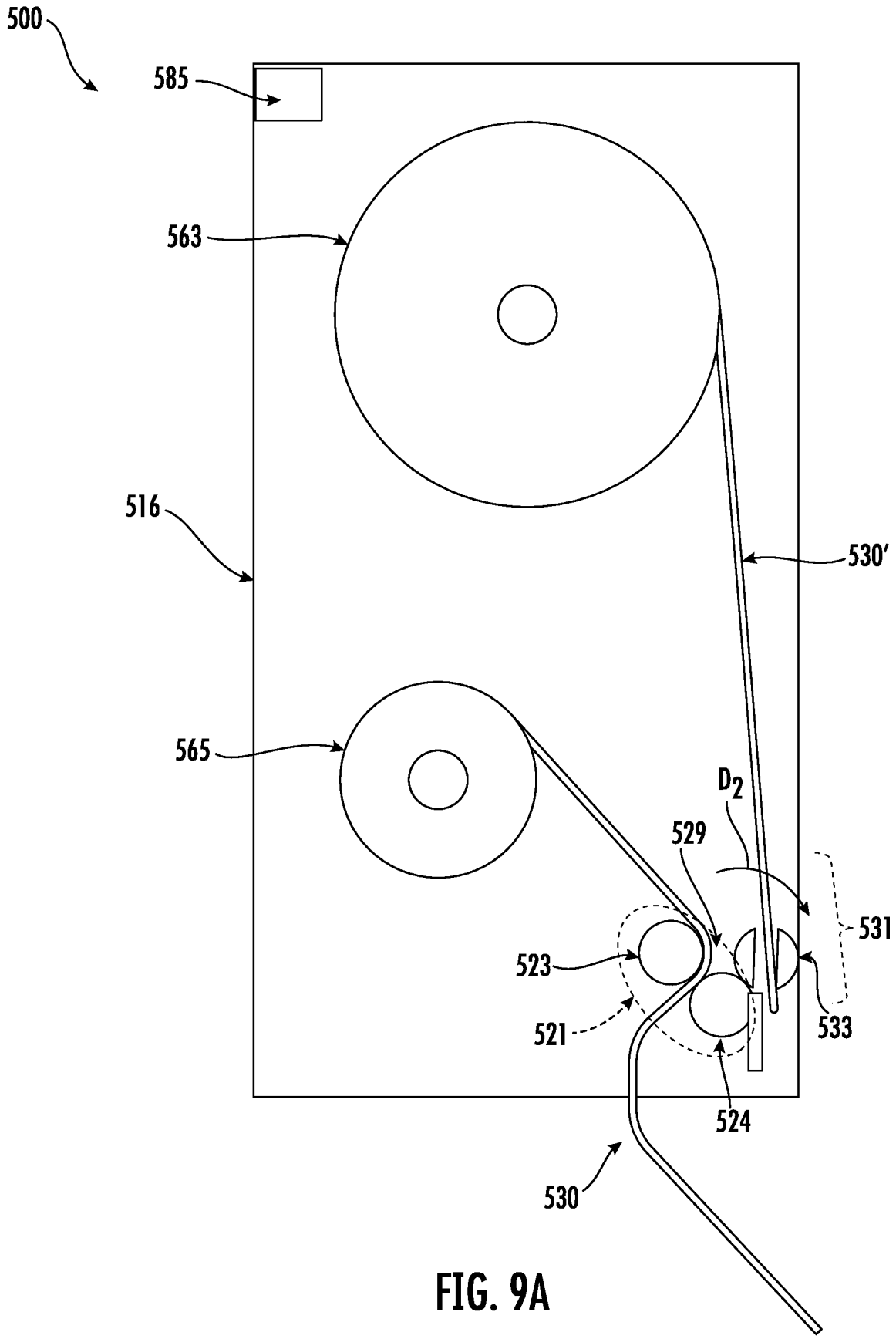
Figure 9B:
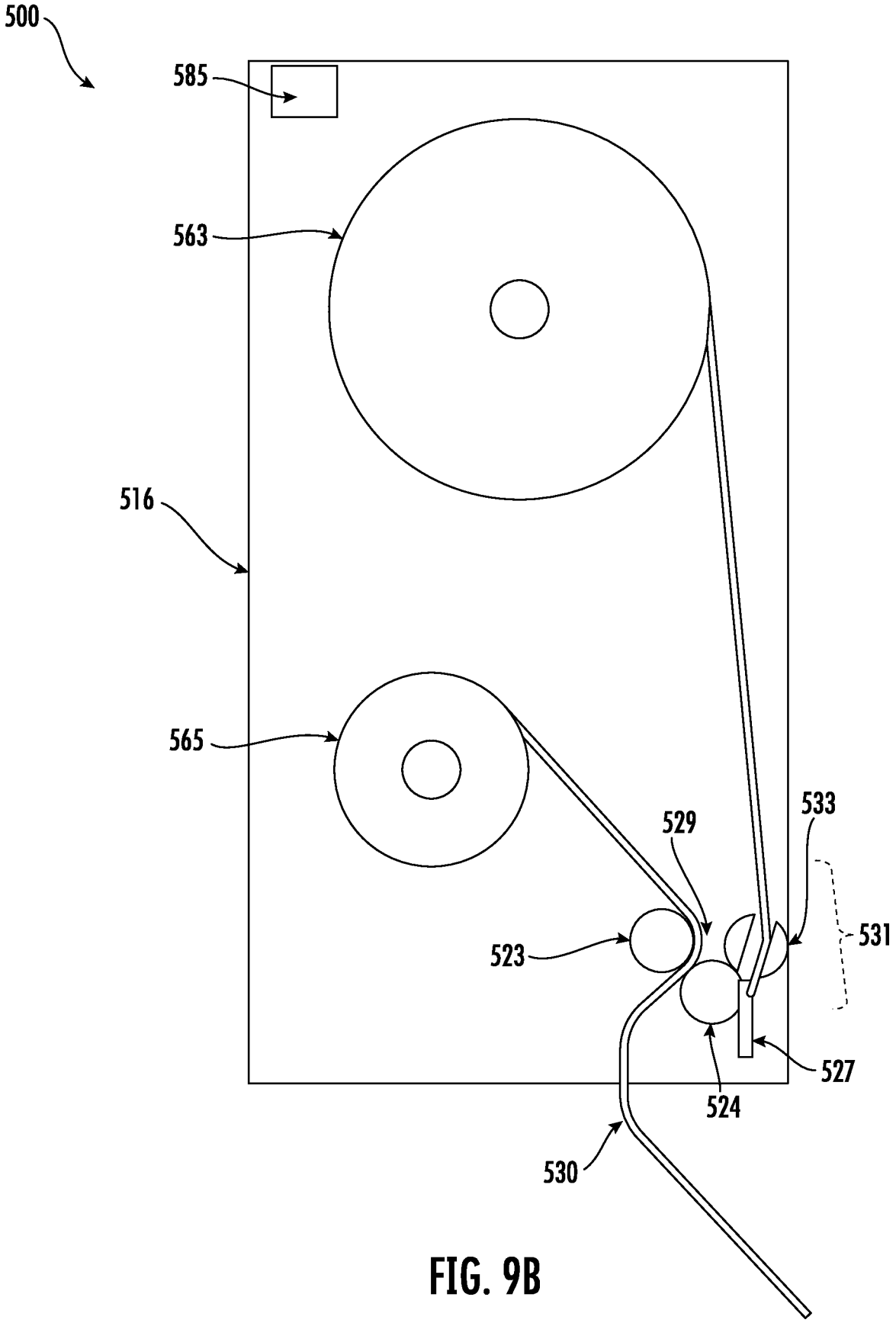
Figure 9C:
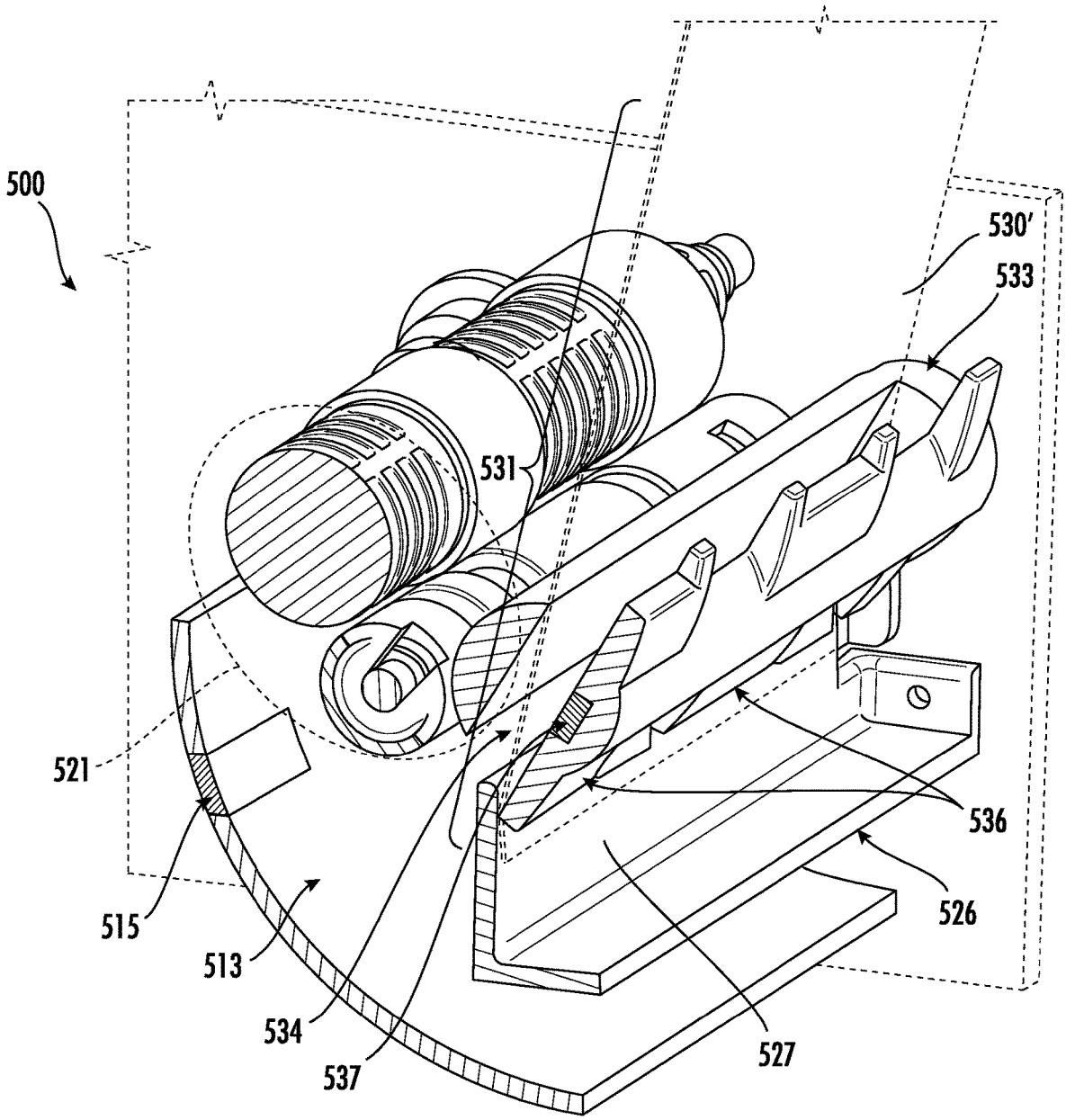
Figure 10A:
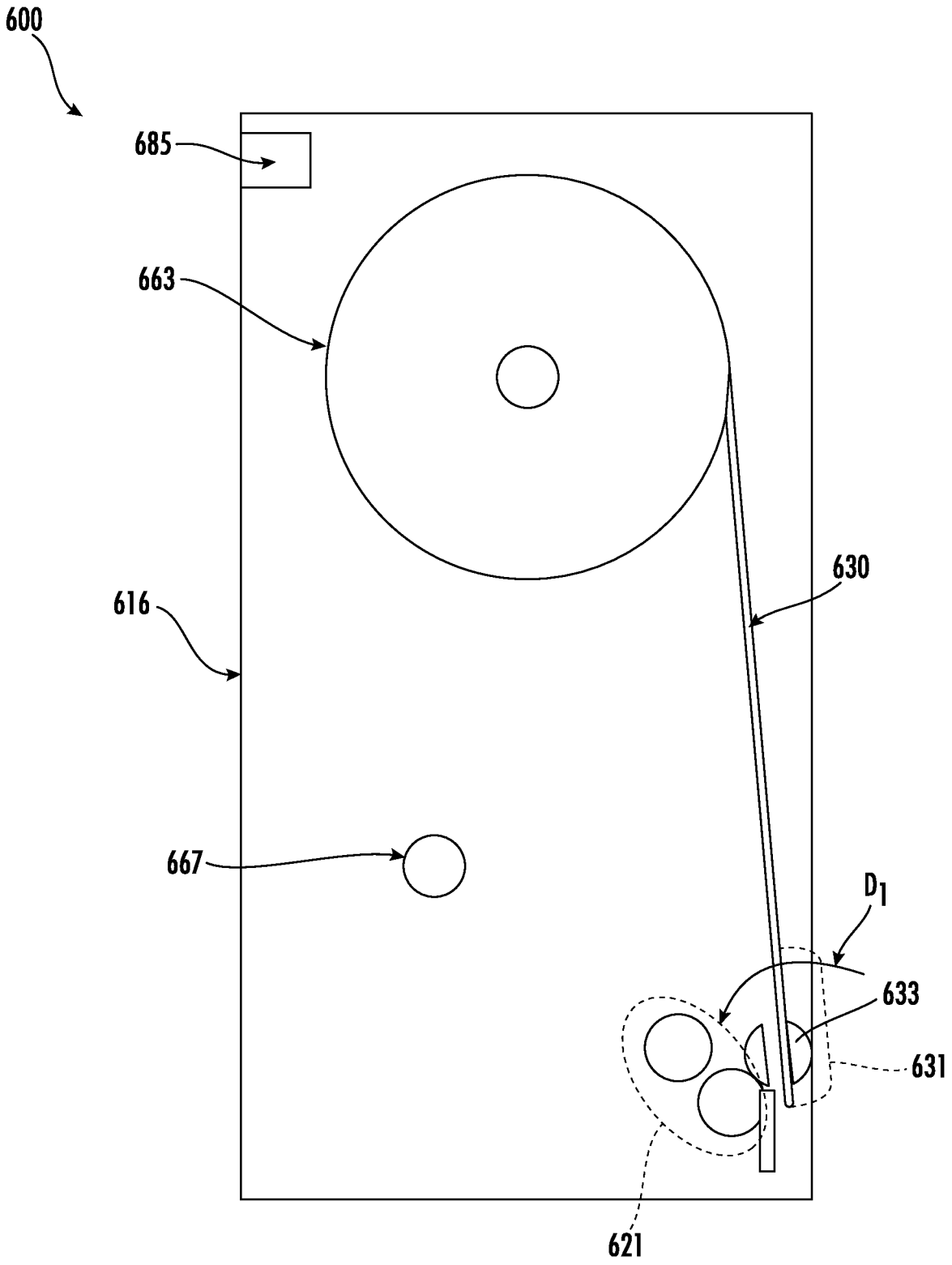
Figure 10B:
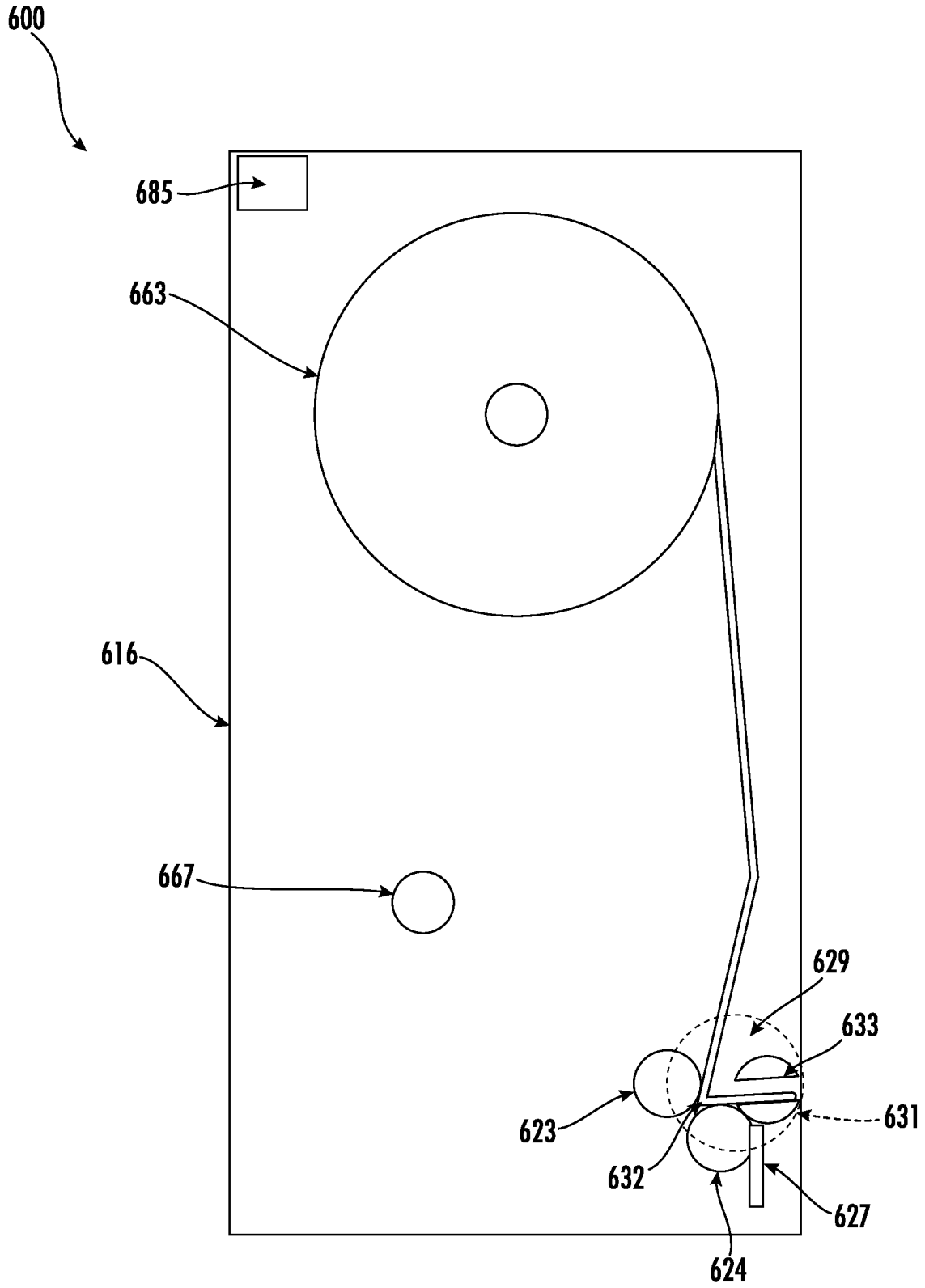
Figure 10C:
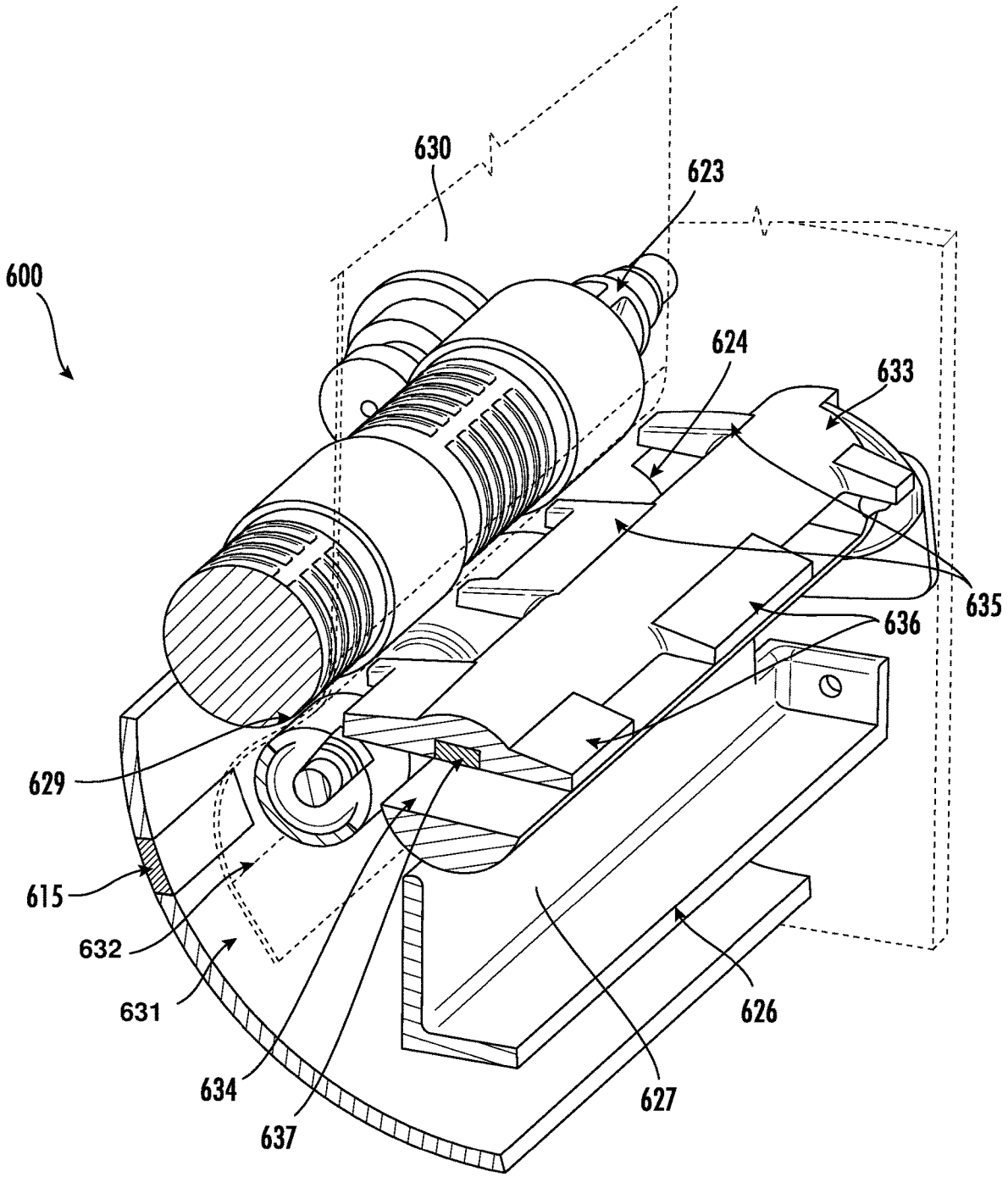
Figure 10D:
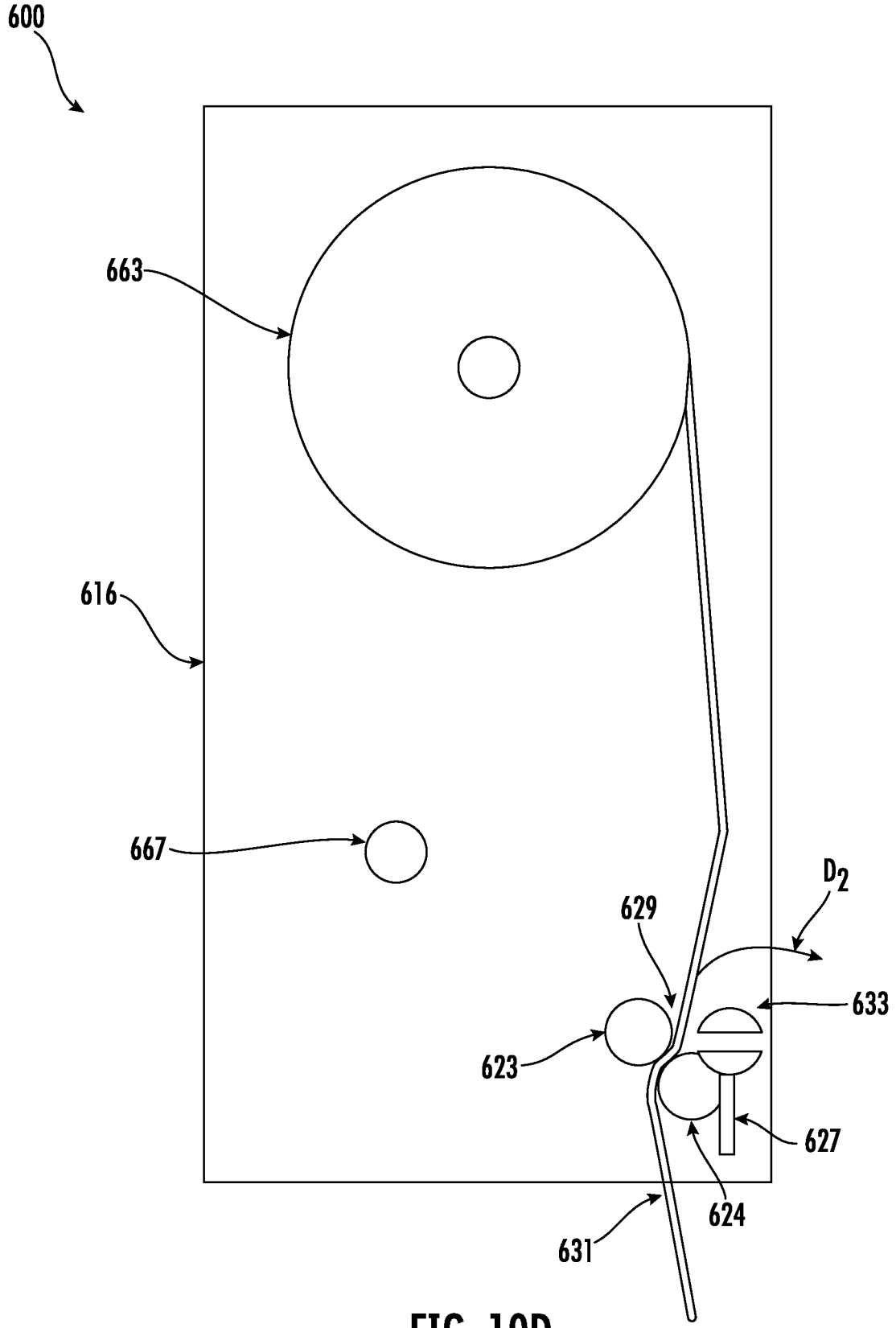
Figure 10E:
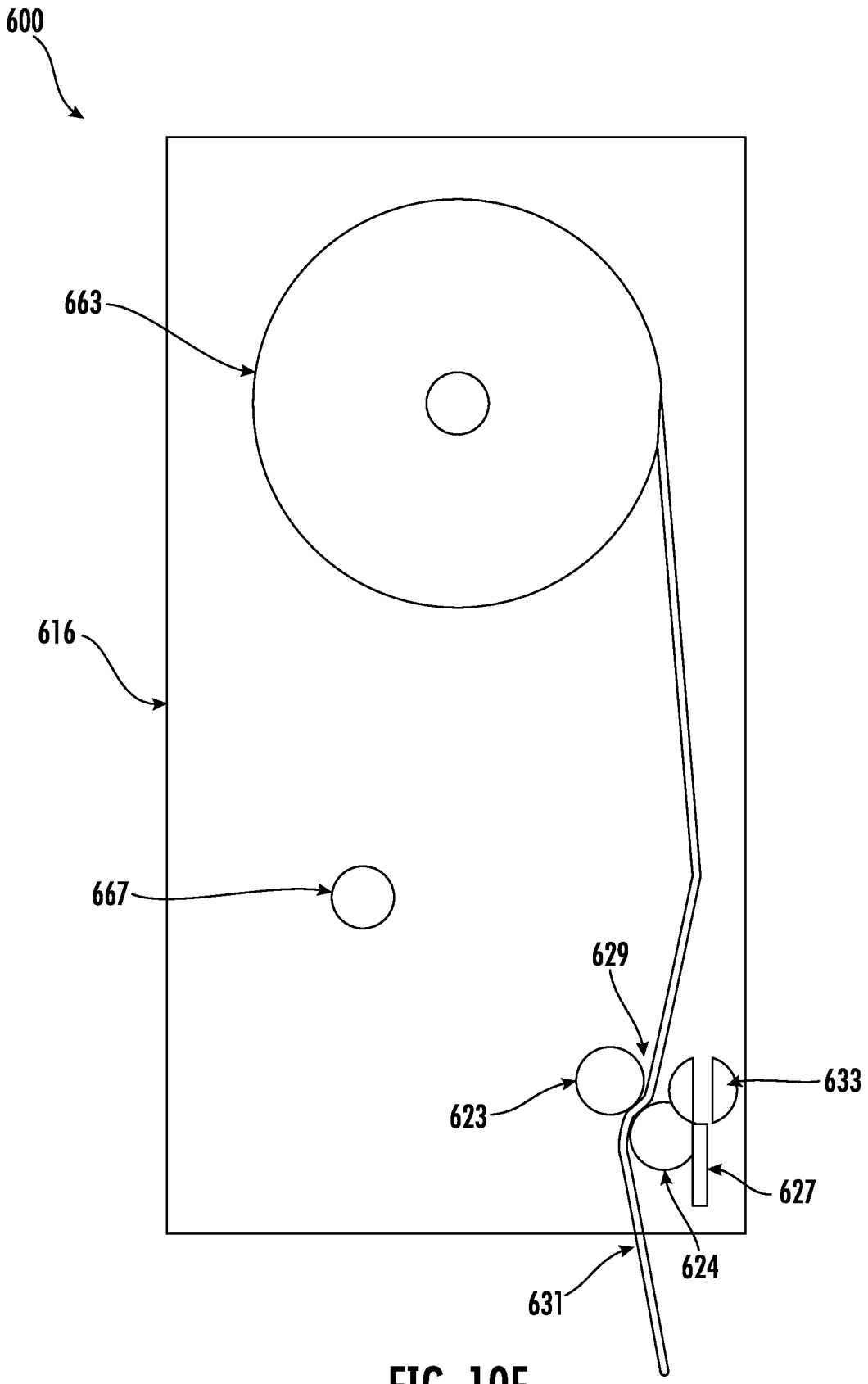
Figure 11:
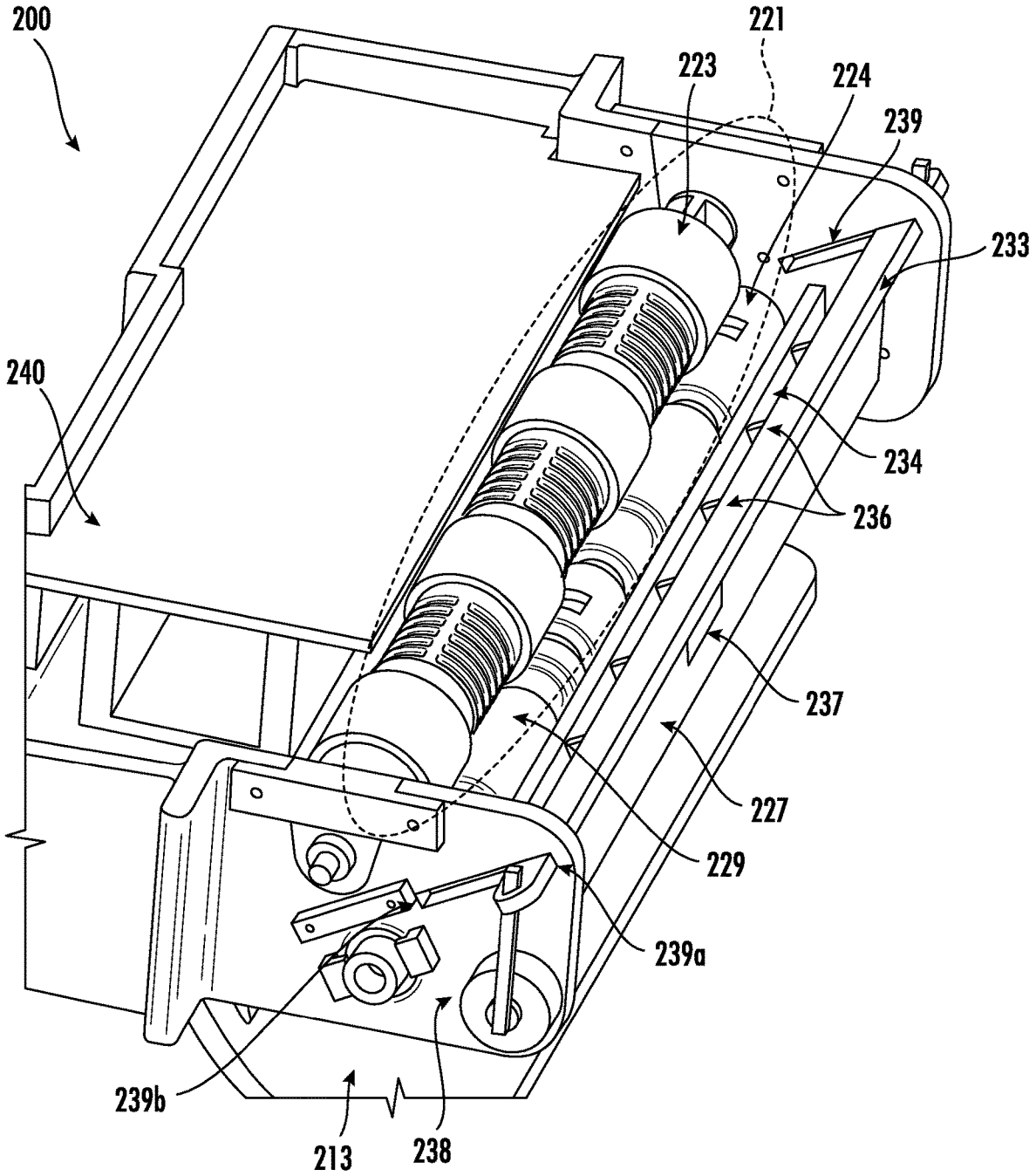
Figure 12:
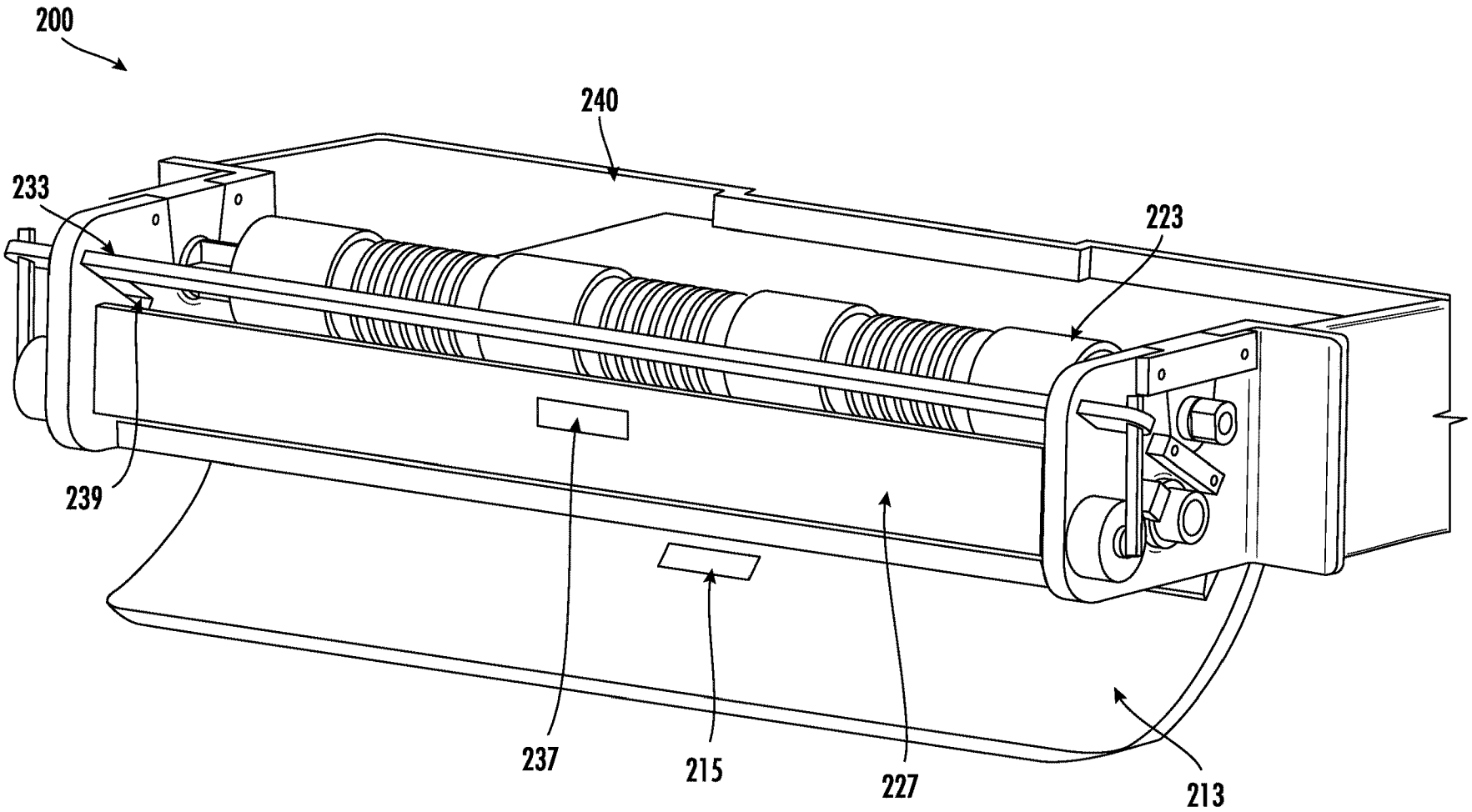
Figure 13:
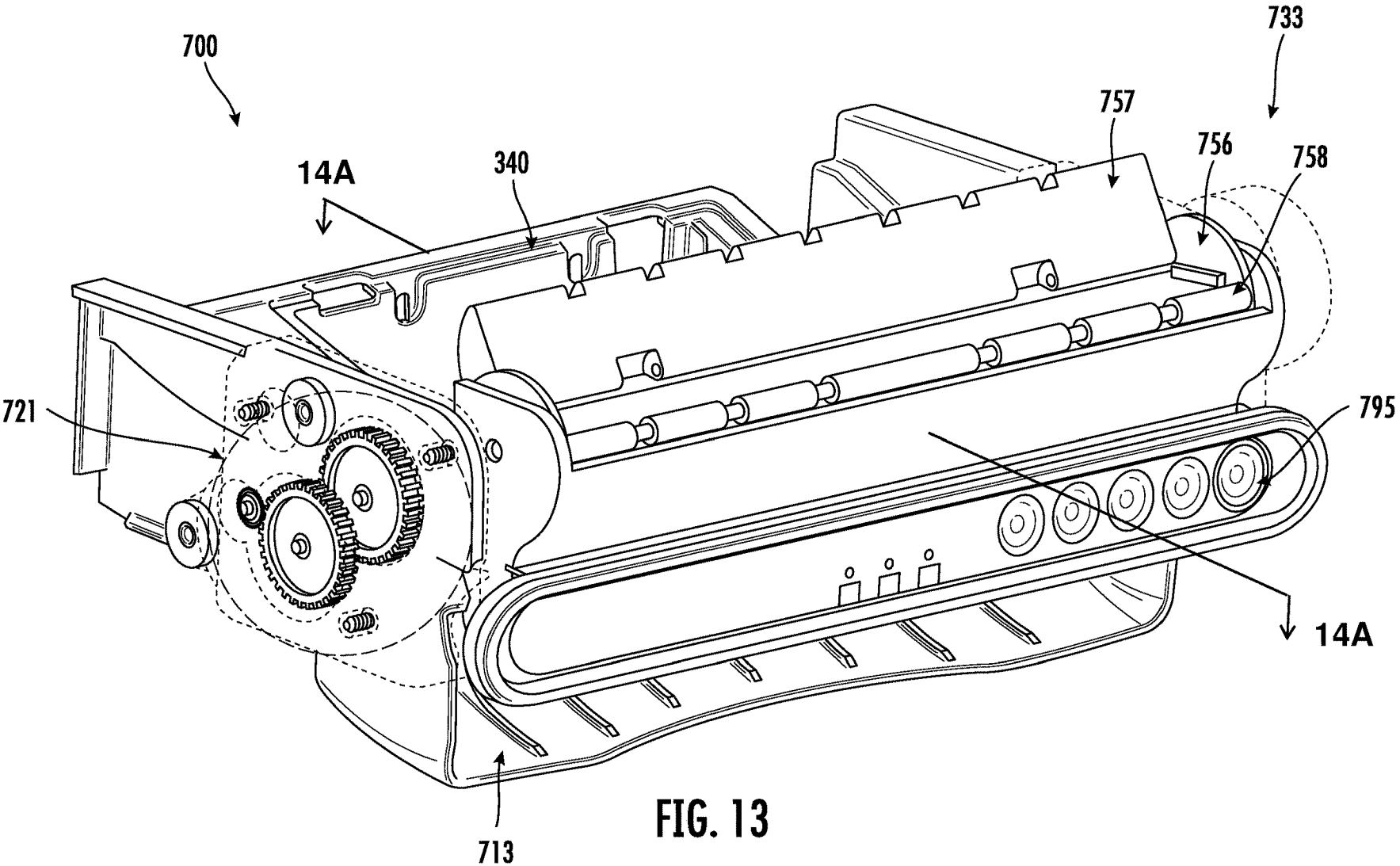
Figure 14A:
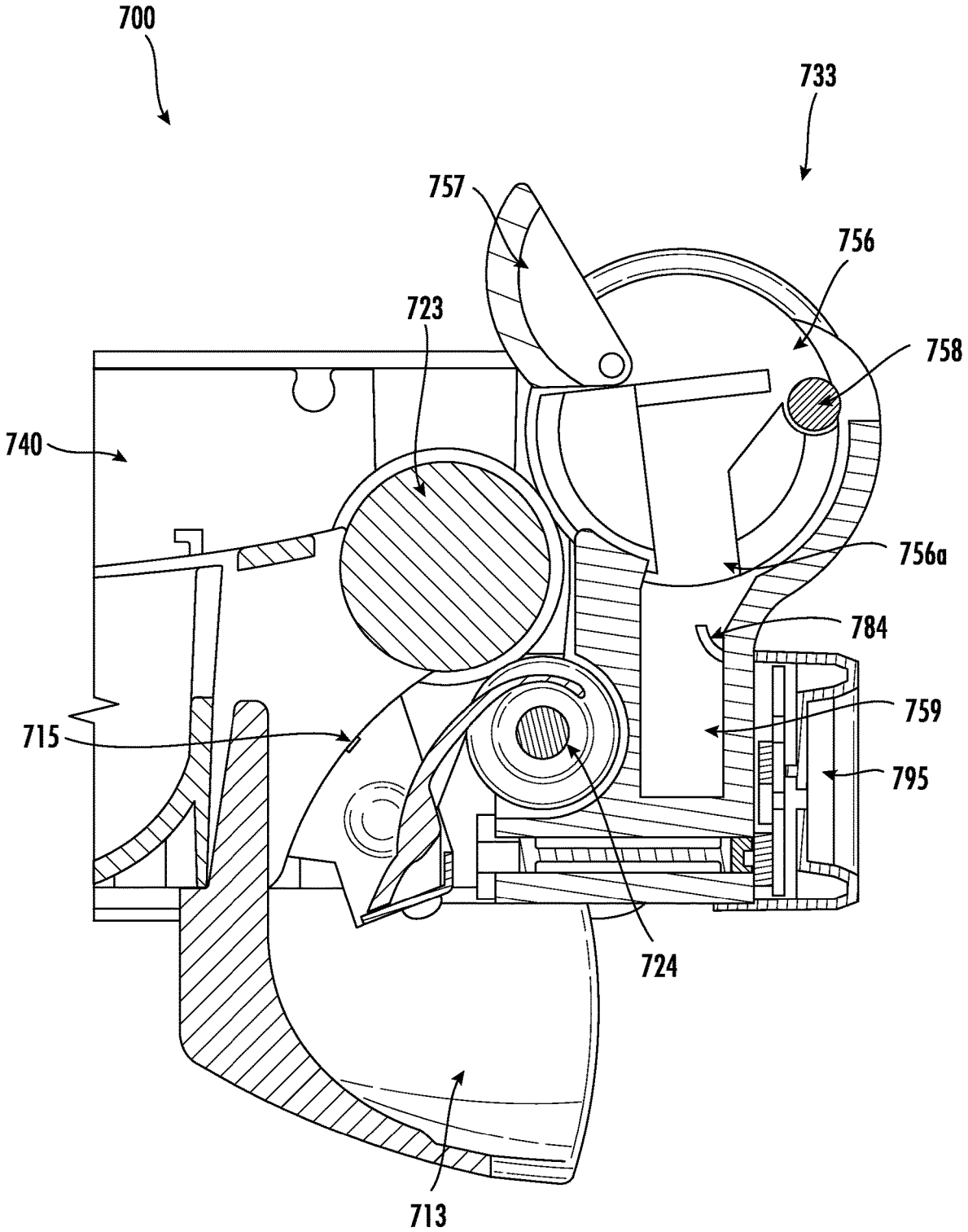
Figure 14B:
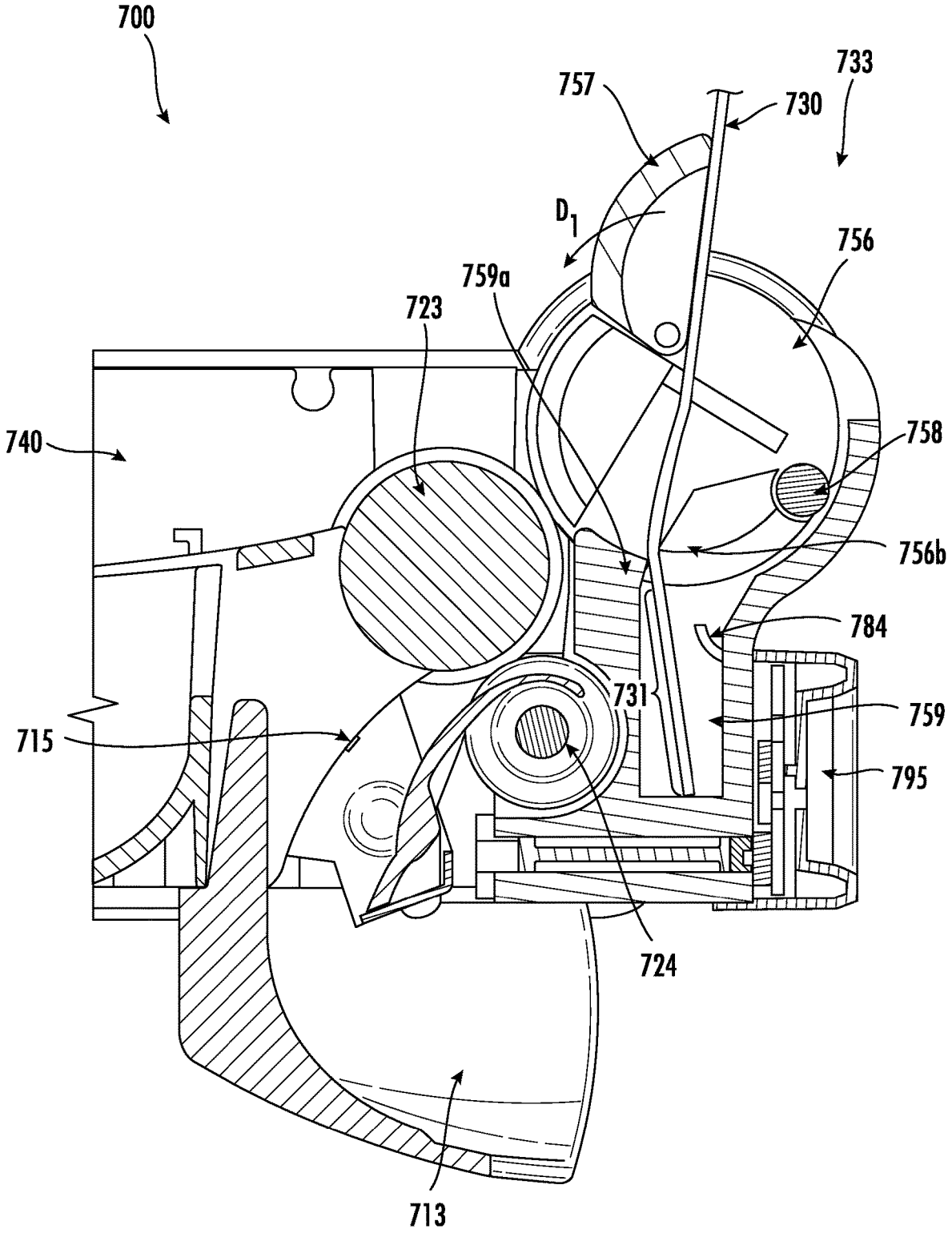
Figure 14C:
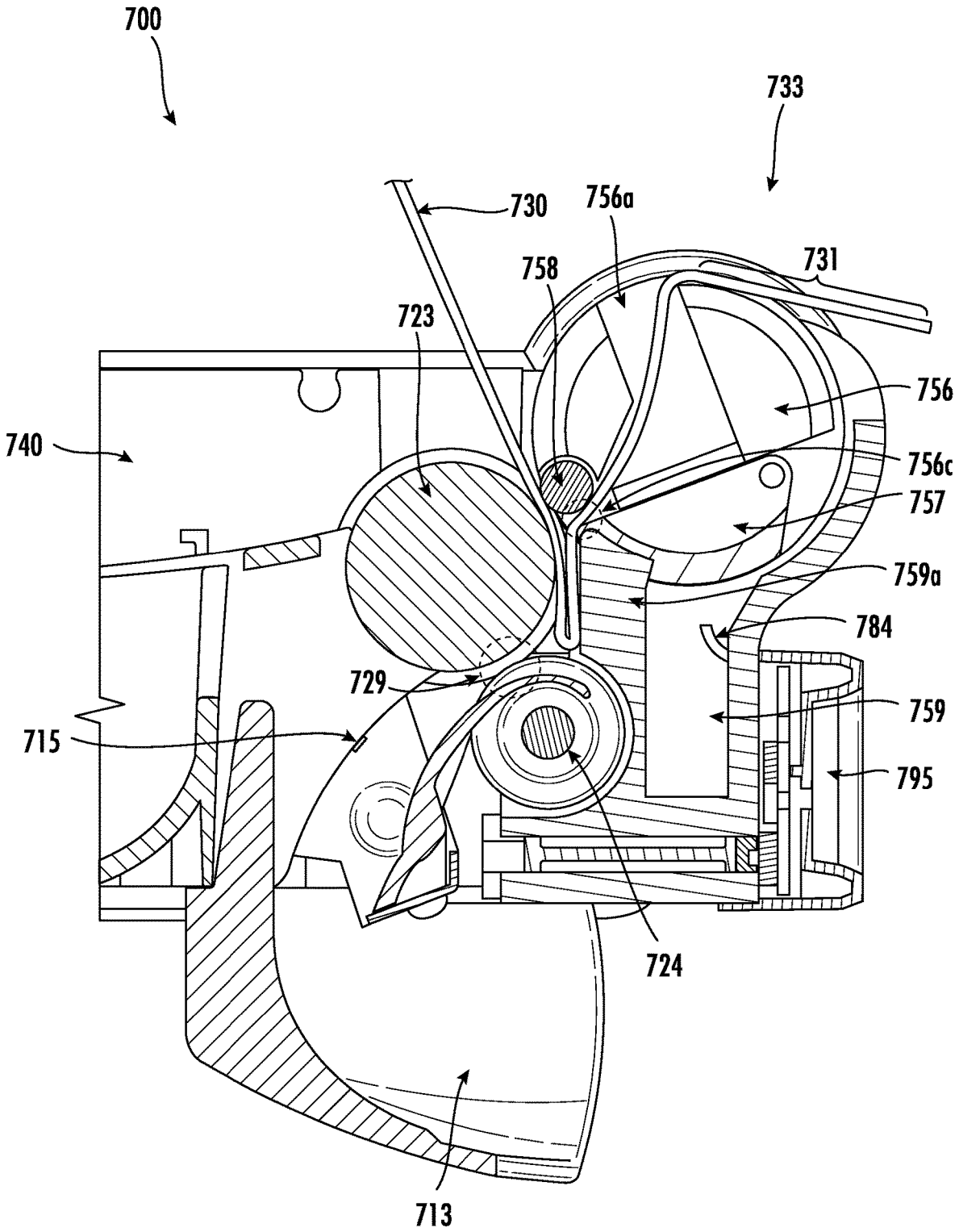
Figure 14D:
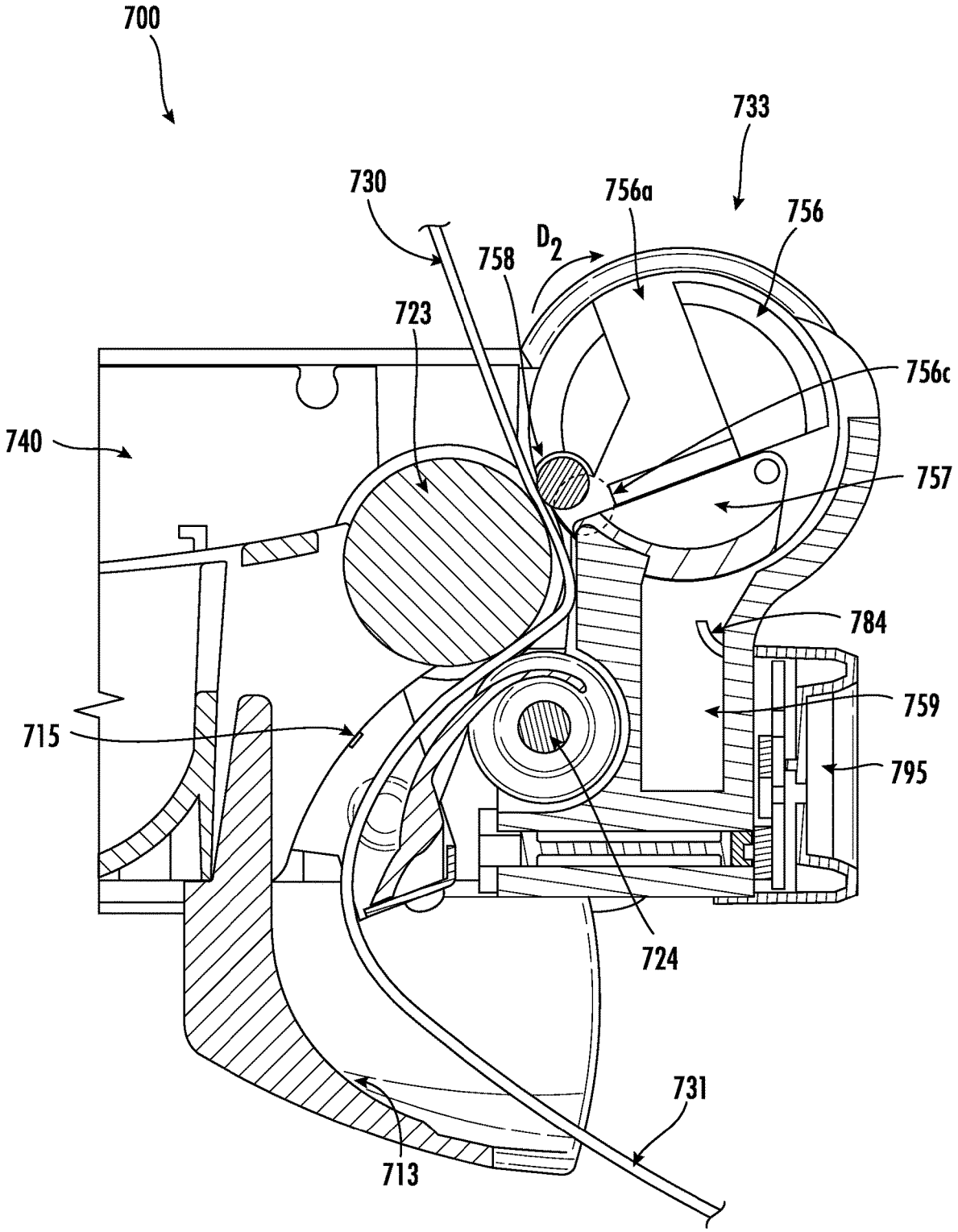
Figure 14E:
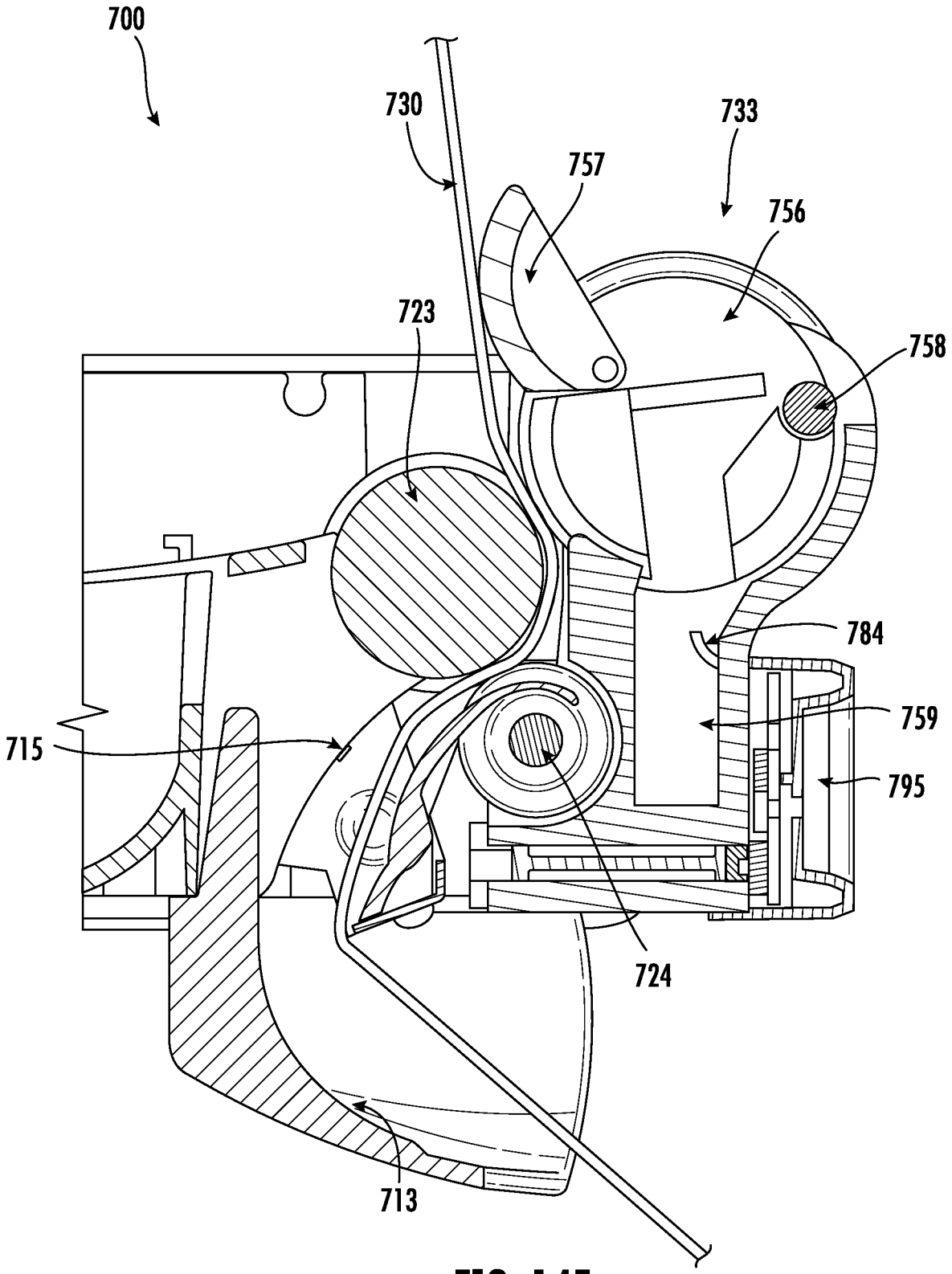
Figure 15:
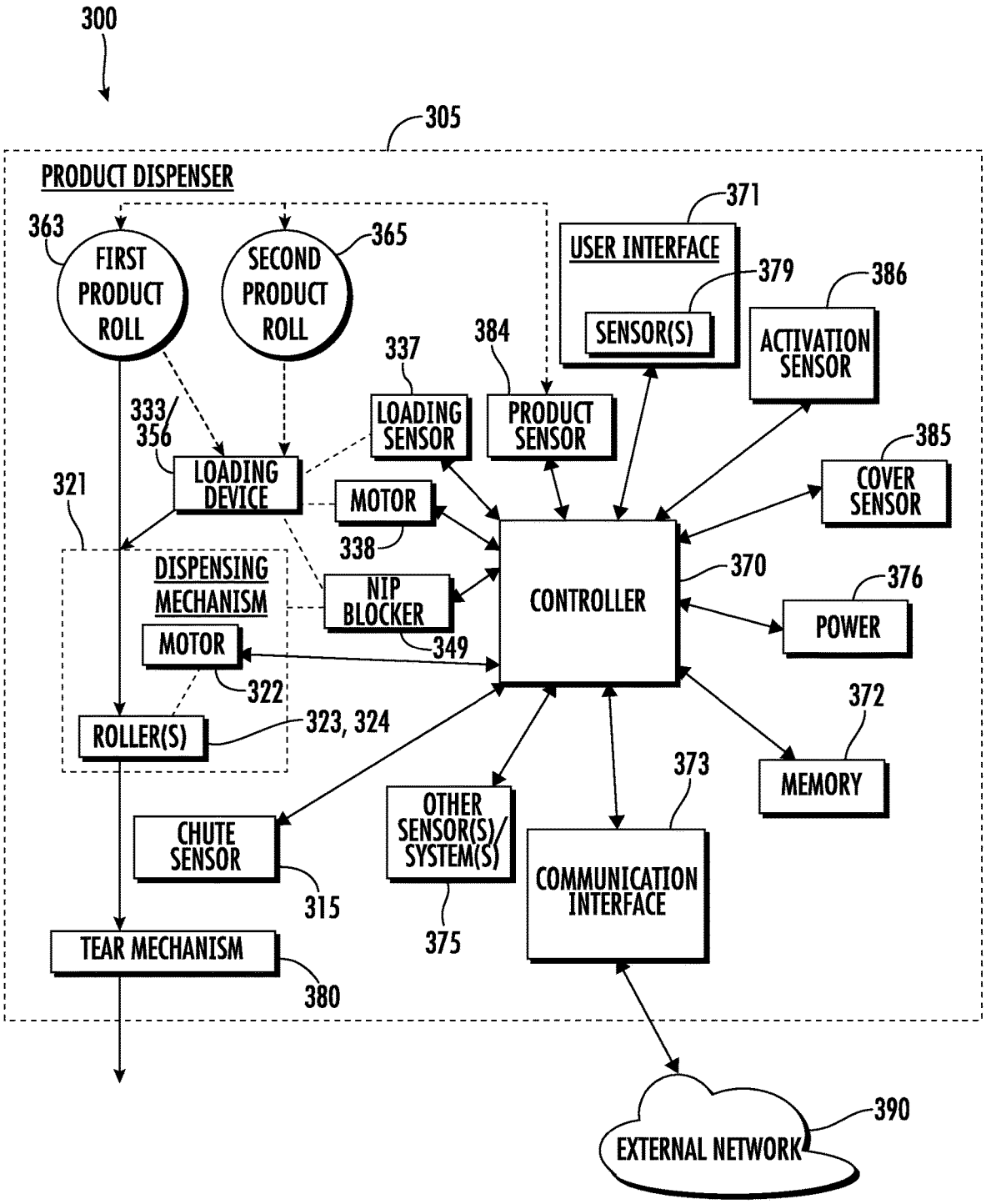
Figure 16:
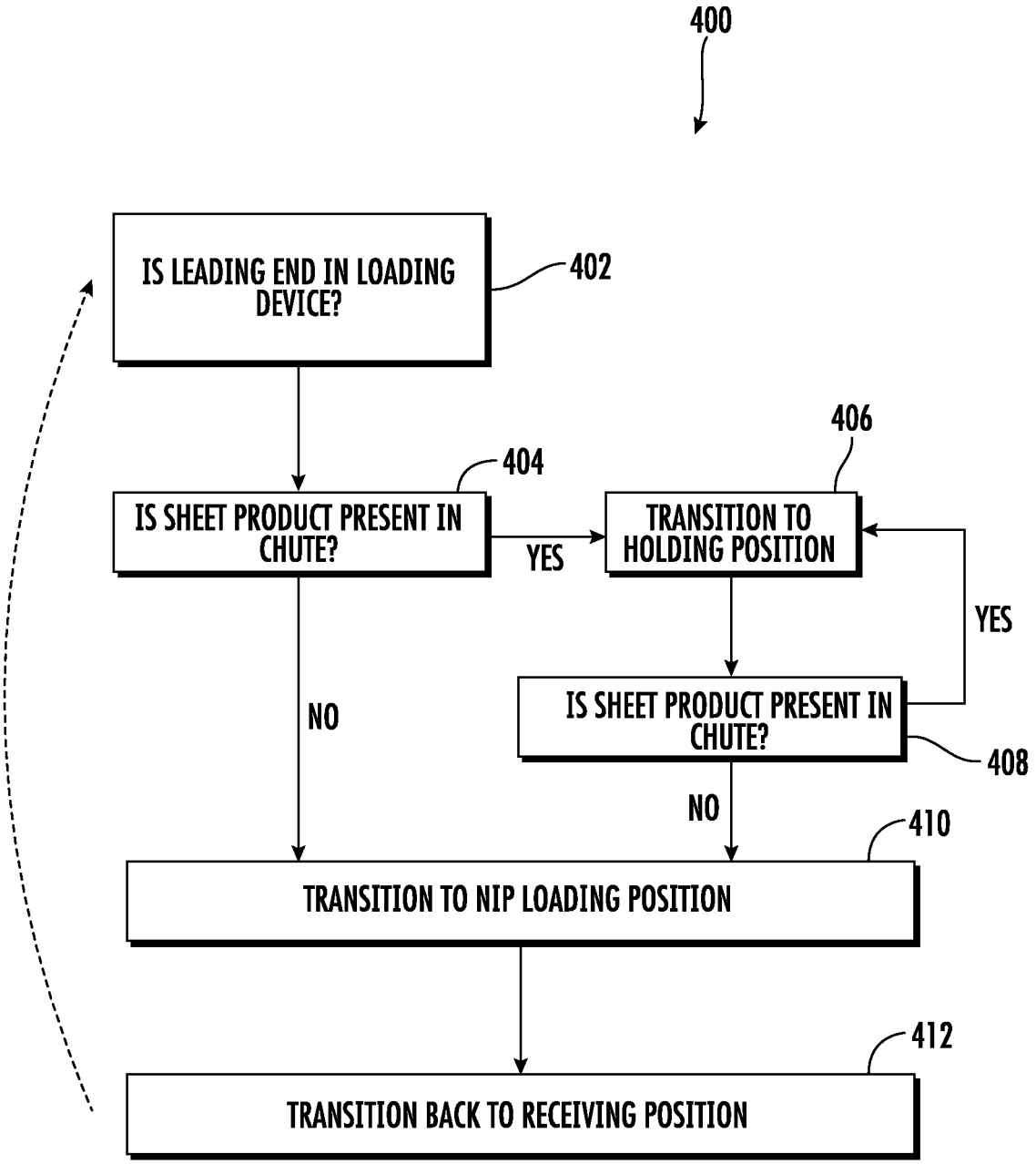

Having thus described the invention in general terms, reference will now be made to the accompanying drawings, which are not necessarily drawn to scale, and wherein:

FIG. 1 shows a perspective view of an example sheet product dispenser, in accordance with some embodiments discussed herein;

FIG. 2 shows a perspective view of the example sheet product dispenser shown in FIG. 1, with the cover in an open position, in accordance with some embodiments discussed herein;

FIG. 3A shows a cross-sectional view of an example sheet product dispenser taken along line 1-1 in FIG. 1, where a stub roll is loaded into the dispensing mechanism and the maintainer is to load the leading end of the new replacement roll into the loading device, in accordance with some embodiments discussed herein;

FIG. 3B shows another cross-sectional view of the example sheet product dispenser taken along line 1-1 in FIG. 1, where no stub roll is loaded into the dispensing mechanism and the maintainer is to still load the leading end of the new replacement roll into the loading device, in accordance with some embodiments discussed herein;

FIG. 4 shows a partially transparent perspective view of an example portion of a chassis that includes a dispensing mechanism and a loading device, in accordance with some embodiments discussed herein;

FIG. 5 shows a partially transparent perspective view of the example portion of the chassis with a leading end of a stub roll loaded into the dispensing mechanism, in accordance with some embodiments discussed herein;

FIG. 6 shows a close up cross-sectional view of the dispensing mechanism and loading device taken along line 5-5 in FIG. 5, in accordance with some embodiments discussed herein;

FIG. 7 illustrates a close-up view of a portion of an example loading device, in accordance with some embodiments discussed herein;

FIG. 8 illustrates a perspective view of a portion of the chassis of the sheet product dispenser, including a dispensing chute below the nip, in accordance with some embodiments discussed herein;

FIG. 9A illustrates a cross-sectional view of the sheet product dispenser with an example loading device in a receiving position, in accordance with some embodiments discussed herein;

FIG. 9B illustrates a cross-sectional view of the sheet product dispenser with the example loading device in a holding position, in accordance with some embodiments discussed herein;

FIG. 9C illustrates a cross-sectional view of the dispensing mechanism of the sheet product dispenser with the example loading device in the holding position, in accordance with some embodiments discussed herein;

FIG. 10A illustrates a cross-sectional view of the sheet product dispenser with the example loading device in a receiving position, in accordance with some embodiments discussed herein;

FIG. 10B illustrates a cross-sectional view of the sheet product dispenser with the example loading device in a nip loading position, in accordance with some embodiments discussed herein;

FIG. 10C illustrates a cross-sectional view of the dispensing mechanism of the sheet product dispenser with the example loading device in the nip loading position, in accordance with some embodiments discussed herein;

FIG. 10D illustrates a cross-sectional view of the sheet product dispenser with the example loading device in the nip loading position after the sheet product is loaded into the nip, in accordance with some embodiments discussed herein;

FIG. 10E illustrates a cross-sectional view of the sheet product dispenser with the sheet product loaded in the nip and the example loading device in the receiving position, in accordance with some embodiments discussed herein;

FIG. 11 illustrates a perspective view of an example chassis including a dispensing mechanism and a loading device, wherein the loading device is configured to transition between positions using linear motion, in accordance with some embodiments discussed herein;

FIG. 12 illustrates a perspective view of the example chassis shown in FIG. 11, in accordance with some embodiments discussed herein;

FIG. 13 illustrates a perspective view of an example chassis including a dispensing mechanism and a loading device, wherein the loading device is configured to transition between positions using rotational motion, in accordance with some embodiments discussed herein;

FIG. 14A illustrates a cross-sectional view of the example chassis shown in FIG. 13 taken along line 14A-14A in the loading position, in accordance with some embodiments discussed herein;

FIG. 14B illustrates a cross-sectional view of the example chassis shown in FIG. 13 take along line 14A-14A with sheet product loaded into the loading device and the loading device being positioned in the holding position, in accordance with some embodiments discussed herein;

FIG. 14C illustrates a cross-sectional view of the chassis shown in FIG. 13 taken along line 14A-14A, wherein the loading device is in the nip loading position, in accordance with some embodiments discussed herein;

FIG. 14D illustrates a cross-sectional view of the chassis shown in FIG. 13 taken along line 14A-14A, wherein the sheet product is loaded into the dispensing mechanism, in accordance with some embodiments discussed herein;

FIG. 14E illustrates a cross-sectional view of the chassis shown in FIG. 13 taken along line 14A-14A, wherein the sheet product is loaded into the dispensing mechanism and the loading device is rotated to a loading position, in accordance with some embodiments discussed herein;

FIG. 15 shows a block diagram illustrating an example sheet product dispenser, in accordance with some embodiments discussed herein; and FIG. 16 illustrates a flowchart of an example method of controlling and operating an example sheet product dispenser, in accordance with some embodiments discussed herein.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout.

As used herein, a "user" of example sheet product dispensers may be a maintainer (e.g., a maintenance person, a janitor, a facility manager, etc.) or a consumer (e.g., a person receiving a dispensed portion of the sheet product).

As used herein, the term "sheet product" may include a product that is relatively thin in comparison to its length and width. Further, the sheet product may define a relatively flat, planar configuration. In some embodiments, the sheet product is flexible or bendable to permit, for example, folding, rolling, stacking, or the like. In this regard, sheet product may, in some cases, be formed into stacks or rolls for use with various embodiments described herein. Some example sheet products include towel, bath tissue, facial tissue, napkin, wipe, wrapping paper, aluminum foil, wax paper, plastic wrap, or other sheet-like products. Sheet products may be made from paper, cloth, non-woven, metallic, polymer or other materials, and in some cases may include multiple layers or plies. In some embodiments, the sheet product (such as in roll or stacked form) may be a continuous sheet that is severable or separable into individual sheets using, for example, a tear bar or cutting blade. Additionally or alternatively, the sheet product may include predefined areas of weakness, such as lines of perforations, that define individual sheets and facilitate separation and/or tearing. In some such embodiments, the lines of perforations may extend along the width of the sheet product to define individual sheets that may be torn off by a user.

As indicated herein, some embodiments of the present invention may be utilized with a sheet product dispenser. For example, certain described embodiments herein may be utilized with paper towel dispensers. In some example embodiments, paper towel dispensers may have components (e.g., roll holders, a lever, a motor, a controller, a drive roller, a pinch roller, etc.) that can be utilized to receive the supply of product (e.g., a roll of sheet product, a stack of sheet product) and facilitate dispensing from the dispenser. Additional information regarding automated and non-automated paper towel dispensers, including components and functionality thereof, can be found in U.S. Pat. Nos. 7,270,292, 5,441,189, 9,999,326, 6,871,815, each of which are assigned to the owner of the present invention and incorporated by reference in their entireties. Some example embodiments may be utilized with paper towel dispensers that are designed to utilize perforated roll towel. Example systems and functions of some such dispensers can be found in U.S. Pat. Nos. 7,887,005, 8,632,030, 9,474,422, and 9,642,503, each of which are assigned to the owner of the present invention and incorporated by reference in their entireties.

Some example embodiments herein may be utilized with tissue product dispensers. In such example embodiments, the tissue dispenser may have components (e.g., roll holders, a rotary mechanism, a motor, a controller, a drive roller, a pinch roller, etc.) that can be utilized to receive the supply of product (e.g., a roll of sheet product) and facilitate dispensing from the dispenser. Additional information regarding example tissue product dispensers, including components and functionality thereof, can be found in U.S. Pat. Nos. 8,162,252 and 7,861,964, both of which are assigned to the owner of the present invention and incorporated by reference in their entireties. Similarly, certain described embodiments herein may be utilized with napkin product dispensers. In such example embodiments, the napkin dispenser may have components (e.g., roll holders, a motor, a controller, a drive roller, a pinch roller, etc.) that can be utilized to receive the supply of product (e.g., a roll of sheet product) and facilitate dispensing from the dispenser. Additional information regarding example napkin product dispensers, including components and functionality thereof, can be found in U.S. Pat. No. 9,604,811, which is assigned to the owner of the present invention and incorporated by reference in its entirety.

FIG. 1 illustrates an example sheet product dispenser 10 according to some embodiments of the present invention, such as in accordance with the sheet product dispenser 305 and its corresponding components described with respect to FIG. 13. The sheet product dispenser 10 includes a housing 16 comprising a base portion 12 and a cover 14. The sheet product dispenser 10 includes at least one dispensing slot 11 where the sheet product (e.g., paper towel) is provided to the user. Such sheet product may, such as described herein, be dispensed in response to user input being provided to an activation sensor 20 (e.g., in the circumstance where the sheet product dispenser is automated).

FIG. 2 illustrates the sheet product dispenser 10 with the cover 14 in an open position, revealing some internal components of the sheet product dispenser 10. The cover 14 may be attached to the base portion 12 and configured to be moved between an open position (shown in FIG. 2) and a closed position (shown in FIG. 1). In some embodiments, the cover 14 may remain attached to the base portion 12 while moving between the closed position and the open position. For example, in the illustrated embodiment, the cover 14 is rotatably attached to the base portion 12 around an axis near a bottom of the base portion 12 (although other opening configurations are contemplated—e.g., the cover 14 opens upwardly, off to either side, etc.).

In order to the open the cover 14, in some embodiments, a maintainer may operate a latch 94 that disengages from a latch receiving portion 92. In some embodiments, the latch 94 may be locked so as to restrict access to the internal components of the sheet product dispenser 10. In some embodiments, the base portion 12 may include a cover sensor 85. The cover sensor 85 may be configured to sense when the cover 14 transitions to the closed position from the open position and/or when the cover 14 transitions from the closed position to the open position. The cover sensor 85 may be in data communication with a controller (e.g., 370 FIG. 13).

The sheet product dispenser 10 may include a first set of roll holders 62*a*, 62*b* and a second set of roll holders 64*a*, 64*b*. While shown without an installed product roll, each set of roll holders may be utilized to install a product roll for holding thereon. For example, a maintainer may slightly separate the second set of roll holders 64*a* and 64*b* to slide in a product roll. The same procedure could be repeated for the first set of roll holders 62*a* and 62*b*. Depending on the sizing of the housing 16, the sheet product dispenser 10 may be configured to hold two full product rolls or one full product roll and one stub product roll (e.g., the product roll has less than a full amount of sheet product). In some embodiments, other types of sheet product sources may be utilized besides rolls of sheet product. For example, the sheet product may be provided in stacked form. The stacks may form a continuous web (e.g., perforated or unperforated) or may be separated and, in some cases, interleaved.

The sheet product dispenser 10 may also include a carriage 60 that is configured to enable physical movement of the sets of roll holders 62*a*, 62*b* and 64*a*, 64*b*. In the illustrated embodiment, the carriage 60 is configured to rotate about an axis 61 to switch physical positions of the sets of roll holders. In this regard, the carriage 60 may be operated by a maintainer to rotate and, therefore, re-position an installed product roll—such as to the position of the second set of roll holders 64*a*, 64*b* shown in FIG. 2. This may, for example, occur after a loading device 46 has changed dispensing to a replacement product roll.

When loading the sheet product dispenser 10, the maintainer may open the cover 14 (such as shown in FIG. 2). When opened, if the transition in which roll is being dispensed from has already occurred, there may be an empty product roll in the second set of roll holders 64*a*, 64*b* and a partially-used product roll (also referred to as "previously installed roll") installed in the first set of roll holders 62*a*, 62*b*. The leading end of the partially-used product roll may be installed in a dispensing mechanism (e.g., dispensing mechanism 21 shown in FIG. 3A) and may be utilized for providing a dispensed portion of the sheet product. The maintainer may then rotate the carriage to reposition the partially-used product roll into the bottom position, freeing up the ability to remove the empty product roll (now at the top) and replace it with a full product roll. Then, the leading end of the replacement product roll (also referred to as "new roll") may be fed into the loading device 46 (e.g., which may be in a receiving position, which will be described in greater detail herein). As detailed herein, the loading device may transition to a holding position to hold the leading end for when transition to dispensing from the new replacement product roll is appropriate. With the replacement product roll installed, the cover 14 may be closed and the sheet product dispenser is ready for operation.

In some embodiments, various components of the sheet product dispenser 10 may be formed within a chassis 40 that can be installed within the housing 16 of the sheet product dispenser 10. An example chassis 40 is shown in FIG. 2. The chassis 40 may form a part that may be installed within the sheet product dispenser 10. In this regard, should maintenance be required, the chassis 40 may be removed altogether and replaced with another chassis without having to replace the entire sheet product dispenser 10. Utilizing such a chassis 40 also creates easier assembly of the sheet product dispenser 10.

FIGS. 3A-B illustrate cross-sectional views of the sheet product dispenser 10 shown in different statuses that may occur when a maintainer wants to insert a new product roll. FIG. 3A illustrates the sheet product dispenser 10 having a replacement roll 63 and a stub roll 65 within the housing 16. The sheet product 30 extending from the stub roll 65 is positioned within the dispensing mechanism 21. The dispensing mechanism 21 defines a nip 29 formed by a drive roller 23 abutting a pinch roller 24. In the illustrated embodiment, the sheet product 30 of the stub roll 65 is dispensed through the dispensing mechanism 21 to a user. Thus, when a maintainer loads the replacement roll 63, the leading end 31 may be positioned in the loading device 46, such as through the slot 45. Notably, the same loading device 46 may also be used in the situation where there is no stub roll loaded in the product dispenser 10. For example, FIG. 3B illustrates the sheet product dispenser 10 with no stub roll (the bottom roll holder 66 is empty) and, thus, where there is no sheet product in the dispensing mechanism 21. In that case, the maintainer will also install the leading end 31 of the replacement roll 63 into the loading device 46, such as through the slot 45.

In this regard, embodiments of the present invention provide a consistent loading experience for the maintainer regardless of the current loading status of the sheet product dispenser. Notably, this avoids the situation where the maintainer might ordinarily need to load the leading end 31 of the replacement roll 63 directly into the nip 29 (such as would normally be the case with the illustrated embodiment of FIG. 3B) versus where the maintainer should not load the leading end 31 directly into the nip 29 because the stub roll 65 is already loaded therein (which would be the case with the illustrated embodiment of FIG. 3A). Notably, embodiments of the present invention may also discourage attempted loading of an extra roll when there is not space for the roll in the sheet product dispenser (as the loading device would already have a leading end inserted therein). Thus, as explained herein, for embodiments of the present invention, the maintainer always positions the sheet product within the loading device, thereby alleviating confusion and inconsistencies.

In some embodiments, a nip blocker may be provided to prevent a maintainer from loading the leading end of a replacement roll directly into the nip. For example, a physical obstruction may prevent the loading of sheet product into the nip. With reference to FIGS. 3A-B, the loading device 46 may define a nip blocker 49 that blocks access to the nip 29 in the receiving position. In this regard, in such embodiments, the maintainer is prevented from loading the leading end into the nip 29 in either the circumstance where a stub roll is present and loaded into the nip (e.g., FIG. 3A) or not (e.g., FIG. 3B). As will be shown and described herein, when the loading device transitions to a nip loading position (to load the leading end 31 of the replacement roll 63 into the nip 29), the nip blocker 49 is configured to move to enable that access. In the illustrated embodiment, the nip blocker 49 forms a back portion of a slotted roller defining the loading device 46. Notably, however, other shapes and configurations for the loading device and/or nip blocker are contemplated. Additionally or alternatively, the nip blocker may form a separate component rather than be a part of the loading device. Such an example feature may help guarantee that a maintainer must load the leading end into the loading device.

FIG. 4 illustrates a portion of a sheet product dispenser 100 including a dispensing mechanism 121, a loading device 133, a holder 126, and a dispensing chute 113 positioned on a chassis 140 within a housing (e.g., 16 shown in FIG. 3A) of the sheet product dispenser 100. The sheet product dispenser 100 may be configured to hold a first roll of sheet product and a second roll of sheet product (e.g., shown in FIG. 3A). In some embodiments, the first roll of sheet product may be a replacement roll, and the second roll of sheet product may be a stub roll.

The dispensing mechanism 121 may comprise a drive roller 123 and a pinch roller 124 forming a nip 129 therebetween. In some embodiments, the nip 129 may be configured to receive sheet product from either the first sheet product roll or the second sheet product roll and dispense the loaded sheet product into the dispensing chute 113, thereby providing a dispensed portion to a user.

In some embodiments, the drive roller 123 may comprise alternating sections. A first drive roller section 123*a* may be a smooth, rubber (or rubber-like) surface configured to engage with the sheet product. A second drive roller section 123*b* may define a patterned surface to engage with the loading device 133.

In some embodiments, the drive roller 123 may be connected to a dispensing mechanism motor 122. The dispensing mechanism motor 122 may be operated to drive rotation of the drive roller 123, such as via a set of gears. Rotation of the drive roller 123 along with the friction between the sheet product and the nip 129 (e.g., where the drive roller 123 and pinch roller 124 have sandwiched the sheet product) causes the sheet product to move along the paper path and be presented within the dispensing chute 113. Depending on the settings of the sheet product dispenser, a predetermined length of sheet product may be dispensed through the dispensing mechanism 121 and presented to a user for retrieval.

In some embodiments, the dispensing chute 113 may define a curved surface leading from the drive roller 123 to the dispensing slot (e.g., 11 shown in FIG. 1). In some embodiments, the dispensing chute 113 may be spaced apart from the drive roller 123, the pinch roller 124 and the loading device 133.

The pinch roller 124 may be positioned adjacent the drive roller 123. In some embodiments, the pinch roller 124 may be configured to rotate in response to movement of the drive roller 123 to pinch the sheet product through the nip 129. In some embodiments, the pinch roller 124 may be positioned slightly below the drive roller 123 within the housing 116 such that the nip 129 is formed at an angle (e.g., an angle that aligns with receiving part of the loading device for transitioning to dispense from the replacement roll of sheet product).

In some embodiments, the loading device 133 may be positioned with respect to the nip 129 to enable feeding of the leading end of the sheet product from within the loading device 133 into to the nip 129 for dispensing from the replacement roll of sheet product. In the illustrated embodiment, the loading device is adjacent to (although not rotationally in contact with) and slightly above the pinch roller 124, and below the drive roller 123 (and also not rotationally in contact with the drive roller 123). The loading device 133 may be configured to transition between a holding position, a receiving position and a nip loading position, such as via a motor 138. In the receiving position, the loading device 133 may be configured to receive a leading end of sheet product being installed as either the first roll of sheet product or the second roll of sheet product.

In some embodiments, the loading device 133 may be configured as a roller configured for rotational movement such that the roller may rotate in a first rotational direction and a second rotational direction opposite the first rotational direction. In some embodiments, the loading device 133 may be configured as an elongated bar configured for linear movement towards the dispensing mechanism 121 and away from the dispensing mechanism 121.

In some embodiments, with reference to FIG. 6, the loading device 133 may comprise a slot 134 extending along the body of the loading device 133. In some embodiments, the loading device 133 may comprise upper prongs 135 on an upper side of the loading device 133. The upper prongs 135 may be positioned such that, in the loading position, the slot 134 is positioned between the upper prongs 135 and the pinch roller 124. The upper prongs 135 may be sized such that when the loading device 133 transitions to a nip loading position, the upper prongs 135 engage with the second drive roller section 123*b*. Said differently, the upper prongs 135 are sized such that at least a portion of the upper prongs 135 may extend across the pinch roller 124 and engage with the drive roller 123—thereby ensuring that the leading end of sheet product installed within the slot 134 will engage with the dispensing mechanism 121 and enter the nip 129.

In some embodiments, returning to reference FIG. 3B, for example, a nip blocker 49 (see also, for example, 349 in FIG. 15) may be positioned between the nip 29 and the loading device 46 when the loading device 46 is in the receiving position, as noted above. When the loading device 46 transitions to the nip loading position, the nip blocker may shift to an unblocking position to allow the sheet product to enter into the nip 29. Although illustrated as part of the loading device 46, in some embodiments, the nip blocker may be separate from the loading device (e.g., separately actuatable to move to the unblocking position).

Returning to FIG. 4, in some embodiments, the loading device 133 may comprise lower prongs 136 extending opposite the upper prongs 135. The lower prongs 136 may be positioned such that in the loading position, the slot 134 extends between the lower prongs 136 and a holder 126. In some embodiments, the lower prongs 136 may be symmetrical to the upper prongs 135. In some embodiments, the lower prongs 136 may be configured to hold the sheet product against a surface 127 of the holder 126 (e.g., 527 shown in FIG. 9C).

The holder 126 may be secured in the chassis 140 below the loading device 133. In some embodiments, the holder 126 defines a bottom edge 128 extending from the surface 127. In some embodiments, the bottom edge 128 may be perpendicular to the surface 127, while in other embodiments the bottom edge 128 may be angled to prevent sheet product from contacting the dispensing chute 113. In some embodiments, the surface 127 of the holder 126 may be aligned with the slot 134 of the loading device 133 such that when the leading end of the sheet product is within the slot 134, the holder 126 prevents the sheet product from engaging with the nip 129 (e.g., via the pinch roller 124 or the drive roller 123) and being dispensed into the dispensing chute 113.

The loading device 133 may be configured to transition between a receiving position, a holding position (see e.g., FIGS. 9B-C), and the nip loading position (see e.g., FIGS. 10B-C). In the receiving position, the leading end of the sheet product may be inserted into the slot 134 extending within the loading device 133. In the holding position, sheet product may be held within the slot 134, such as against the surface 127 of the holder 126 such that the leading end of the sheet product is positioned away from the nip 129 of the dispensing mechanism 121 such that that dispensing mechanism 121 does not dispense the sheet product. In the nip dispensing position, the leading end of the sheet product may be positioned to enter the nip 129 of the dispensing mechanism 121 to cause the dispensing mechanism 121 to begin dispensing the sheet product.

FIG. 5 illustrates a partially transparent view of the chassis 140 of the sheet product dispenser 100 including a stub roll 165 installed in lower roll holders with sheet product therefrom being dispensed through the nip 129 of the dispensing mechanism 121. In some embodiments, the stub roll 165 may be the first roll of sheet product or the second roll of sheet product. As illustrated, the sheet product 130 of the stub roll 165 extends into the nip 129 of the dispensing mechanism. As discussed, a paper path may lead from a nip 129 (between the drive roller 123 and the pinch roller 124) to the end of the dispensing chute (e.g., 113 in FIG. 4) where the dispensed portion of the sheet product is presented (including where a portion of the dispensed portion is maintained within the dispensing chute 113, but downstream of the nip 129). With sheet product from the stub roll 165 extending into the nip 129, the loading device 133 may be positioned in the receiving position, ready to receive the leading end of a second sheet product roll.

The sheet product dispenser 100 may comprise various sensors to determine when to engage the loading device 133 such as to transition the loading device 133 between various positions. FIG. 6 illustrates a cross sectional view of the sheet product dispenser 100 of FIG. 5 taken along line 5-5. The dispensing mechanism 121 may utilize a chute sensor 115 positioned within the dispensing chute 113, downstream of the nip 129. In some embodiments, the chute sensor 115 may be positioned in the center of the dispensing chute 113 (see e.g., FIG. 8) such that the width of the sheet product will not affect the reliability of the chute sensor 115. The chute sensor 115 may be configured to collect data regarding whether or not there is sheet product present in the dispensing chute 113 (e.g., the chute sensor 115 may be a break beam sensor, an infrared sensor, a time-of-flight sensor, a camera, an optical sensor, a capacitance sensor, a physical switch/sensor, or any other sensor configured to sense the presence or absence of sheet product within the dispensing chute 113). The sensor may be in communication with a controller (e.g., 370 of FIG. 13). The controller may use the data collected by the chute sensor 115 to determine whether the sheet product is present within the dispensing chute 113. In an instance when the controller determines there is sheet product in the dispensing chute 113, the controller may cause the loading device 133 to remain in or transition to either the receiving position or the holding position. While in an instance when the controller determines that there is not sheet product present within the dispensing chute 113 the controller may cause the loading device 133 to transition to the nip loading position.

The loading device 133 may comprise a loading sensor 137. The loading sensor 137 may be centered within the slot 134 of the loading device 133 on a side of the slot 134. In some embodiments, the loading sensor 137 may be on the side of the loading device 133 with the upper prongs 135, while in other embodiments, the loading sensor 137 may be positioned on the side of the slot 134 opposite the upper prongs 135. The positioning of the loading sensor 137 may allow the sheet product dispenser 100 to utilize sheet products of different widths, without compromising the data collected by the loading sensor (see e.g., FIG. 7). In some embodiments, the loading sensor 137 may be a break beam sensor, an infrared sensor, a time-of-flight sensor, a camera, an optical sensor, a capacitance sensor, a physical switch/sensor, or any other sensor configured to sense the presence or absence of sheet product within the loading device 133 (e.g., within the slot 134 of the loading device 133). The loading sensor 137 may also be in communication with the controller. The loading sensor 137 may be configured to sense when the leading end of the sheet product is received by the loading device 133. The controller, based on data from the loading sensor 137 may determine whether sheet product is present within the loading device 133. The controller may then cause the loading device 133, based on the data from the sensor 115, to transition into the holding position if there is sheet product in the dispending chute 113 or cause the loading device 133 to transition into the nip loading position if there is no sheet product present in the dispensing chute 113 (e.g., based on data from the chute sensor 115). In some such example embodiments, transitioning the loading device 133 to either the nip loading position (to load the leading end into the nip) or the holding position (to hold the leading end for later feeding into the nip) provides instant feedback to the maintainer that the loading procedure they performed was correct. This can be beneficial for providing confidence to the maintainer and promoting future consistent loading by the maintainer.

Notably, in some embodiments, instead of or in addition to utilizing a loading sensor, some embodiments of the present invention may utilize a cover sensor to determine when the cover is closed (e.g., after loading the leading end of the replacement roll is complete and the cover is closed). That determination of closing the cover may trigger the controller to look to see if sheet product is currently in the nip (e.g., via data from the chute sensor) to determine which position to transition the loading device to.

FIGS. 9A-C illustrate an example situation where the loading device transitions to the holding position to hold the leading end of sheet product. The sheet product dispenser 500 comprises a replacement roll 563 and a stub roll 565 within a housing 516. The stub roll 565 is engaged with a dispensing mechanism 521 such that the sheet product 530 of the stub roll 565 is positioned through a nip 529 formed between a drive roller 523 and a nip roller 524 to dispense the sheet product 530.

A maintainer or other user loading the replacement roll 563 into the sheet product dispenser 500 may position a leading end 531 of the sheet product 530' of the replacement roll 563 into a loading device 533. After loading, the maintainer may close the cover of the housing, such that a cover sensor 585 may determine the housing 516 is in the closed position.

In the illustrated embodiment, a loading sensor (e.g., 537 of FIG. 9C) may determine that the leading end 531 of the replacement roll 563 is positioned within the loading device 533 and a chute sensor (e.g., 515 shown in FIG. 9C) may detect sheet product within a dispensing chute (e.g., 513 shown in FIG. 9C). A controller may determine based on the data from the chute sensor and the loading sensor, to cause the loading device 533 to transition into the holding position, illustrated in FIG. 9B, by causing rotation of the loading device 533 in a second rotational direction $D_2$. The second rotational direction $D_2$ may be a direction away from the nip 529, such that the leading end 531 of the sheet product does not get caught in the nip 529 and cause the sheet product dispenser 500 to dispense sheet product from both the replacement roll 563 and the stub roll 565.

FIG. 9B illustrates the loading device 533 in the holding position. When in the holding position, a portion of the leading end 531 of the sheet product may be pinched against a surface (e.g., 527 shown in FIG. 9C) by the loading device 533. Thus, the sheet product dispenser 500 may be configured to dispense the remaining sheet product 530 from the stub roll 565 before utilizing the replacement roll 563 held by the loading device 533 in the holding position.

FIG. 9C illustrates a cross-sectional view of the loading device 533 in the holding position. The leading end 531 of the sheet product 530' may be held within a slot 534 of the loading device 533, such that a portion is held by a lower prong 536 against the surface 527 of a holder 526. Thereafter, upon depletion of the sheet product of the stub roll 565, the controller may determine that no sheet product remains in the dispensing chute and, thus, cause transition of the loading device 533 to the nip loading position to cause the leading end 531 of the replacement roll of sheet product 563 to be loaded into the nip 529 for dispensing therefrom.

In some embodiments, even upon loading of the leading end of the replacement roll into the loading device, the controller may determine that sheet product 530' is present in the loading device 533 (e.g., via the loading sensor 537) and/or assume that sheet product is present in the loading device 533 (e.g., via a cover sensor), and the controller may determine that there is no sheet product within the dispensing chute 513 (e.g., via the chute sensor 515). In this regard, the controller may determine to transition loading device 533 to a nip loading position such that the sheet product 530' of the replacement roll may be dispensed through the dispensing mechanism 521 into the dispensing chute 513 to provide the sheet product 530' to an end user.

In this regard, FIGS. 10A-E illustrate such an example circumstance. In the illustrated embodiment, a housing 616 of a sheet product dispenser 600 may be in the closed position. The housing 616 may contain a replacement roll 663 within the housing 616 and no roll in a second roll holder position 667 where a second sheet product roll may be inserted. A leading end 631 of the sheet product 630 of the replacement roll 663 may be positioned in a loading device 633. In some embodiments, the loading device 633 may be positioned in the receiving position, as illustrated (although the following description may apply (with slight variations) to the situation where the loading device 633 is in the holding position).

The controller, in response to determining the housing 616 is in the closed position (e.g., from a cover sensor 685) and/or determining that the leading end 631 has been inserted into the loading device 633 (e.g., via a loading sensor 637), and that there is no sheet product within a dispensing chute (e.g., 613 shown in FIG. 10C), may cause a motor (e.g., 138 shown FIG. 4) to transition the loading device 633 from the receiving position, illustrated in FIG. 10A, to the nip loading position, illustrated in FIG. 10B. In some embodiments, the loading device 633 may rotate in a first rotational direction $D_1$, wherein the first rotational direction $D_1$ is towards the dispensing mechanism 621. In other words, the first rotational direction $D_1$ may be opposite the second rotational direction $D_2$.

FIG. 10B illustrates the loading device 633 in the nip loading position. In some embodiments, upper prongs (e.g., 635 in FIG. 10C) of the loading device 633 may cause the leading end 631 of the sheet product 630 to form a fold 632 when rotated to the nip loading position. The upper prongs may engage with a drive roller 623 of the dispensing mechanism 621 to draw the fold 632 through the nip 629. The rotation of the drive roller 623 along with the friction between the leading end 631 and/or the fold 632 of the sheet product 630 and the nip 629 causes the leading end 631 to move through the paper path and be presented within the dispensing chute 613, illustrated in FIG. 10C, thereby pulling sheet product from the replacement roll 663. Accordingly, dispensing of sheet product form the replacement roll 663 may now occur.

Although the example embodiment references the receiving position as the starting position, it should be understood the holding position may also be the starting position of the loading device 633. For example, the controller may determine there is no sheet product present within the dispensing chute 613, and that there is sheet product within a slot 634 of the loading device 633. Accordingly, the loading device motor (e.g., 338 shown in FIG. 13) may cause the loading device 633 to transition from the holding position to the nip loading position. Thus, lower prongs 636 may release the pinch on the sheet product 630 formed between the lower prongs 636 and from a surface 627 of a holder 626.

Once the sheet product previously contained within the loading device 633 is transitioned to the dispensing mechanism 621, the loading device 633 may transition back to the receiving position. As illustrated in FIG. 10D, the loading device 633 may rotate in the second rotational direction $D_2$. The second rotational direction $D_2$ as discussed above may be away from the nip 629. Thus, as illustrated in FIG. 10E, the loading device 633 may be in the receiving position such that when a maintainer opens the housing 616 to replenish the sheet product, the positioning of the loading device 633 may indicate to the maintainer to position the leading end of the sheet product within the loading device 633.

In some embodiments, rather than rotational motion to transition the loading device between the holding position, receiving position, and nip loading position the loading device may use other types of motion, such as linear motion. FIGS. 11-12 illustrate a portion of a chassis 240 configured to be positioned within a housing of a sheet product dispenser 200 in accordance with various embodiments of the present invention. In some embodiments, sheet product dispenser 200 may comprise a dispensing mechanism 221 and a loading device 233. The dispensing mechanism 221 may comprise a drive roller 223 adjacent a pinch roller 224, forming a nip 229 therebetween. The dispensing mechanism 221 may comprise similar properties and function similarly to dispensing mechanism 121 discussed above with reference to FIGS. 4-8.

In some embodiments, the loading device 233 may be formed as a bar extending across the chassis 240. The bar may comprise at least one prong 236 extending towards the dispensing mechanism 221. In some embodiments, the loading device 233 may be oriented such that the at least one prong 236 is oriented at the same angle as the nip 229 (and the loading device 233 linearly moves in a direction toward or away from the nip 229, such as in the guide slot 239).

In some embodiments, a surface 227 may be positioned between the loading device 223 and the pinch roller 224. The surface 227 may extend above the pinch roller 224 but may be lower than the drive roller 222 such that the at least one prong 236 may clear the surface 227 to insert sheet product into the dispensing mechanism 221. In some embodiments, the surface 227 may have a loading sensor 237 centered within the surface 227 and configured to determine whether or not there is sheet product within a slot 234 formed between the surface 227 and the loading device 233.

In some embodiments, the loading device 223 may transition between the holding position, receiving position, and nip loading position via linear motion. To explain, the loading device 233 may be configured to move though a liner motion guide slot 239 formed within the chassis, such as via a motor 238. In some embodiments, the holding position may be when the loading device 233 is positioned in a first end 239*a* of the linear motion guide slot 239. The first end 239*a* may be the position farthest away from the dispensing mechanism 221. In contrast, the nip loading position may be when the loading device 233 is positioned at a second end 239*b* of the linear motion guide slot 239. The second end 239*b* may be the position closest to the dispensing mechanism 221. In some embodiments, the holding position may be the same as the receiving position, while in other embodiments, the holding position may be where the loading device 233 is positioned between the first end 239*a* and the second end 239*b* of the linear motion guide slot 239.

In some embodiments, when the loading device 233 is in the holding position, the sheet product is positioned to abut the surface 227 and the at least one prong 236 of the loading device 223. In some embodiments, when the loading device 233 is in the nip loading position, the at least one prong 236 is configured to abut the nip 229 such that the sheet product forms a fold received by the nip 229. Thus, in the transition between the holding position and the nip loading position, the at least one prong 236 is configured to move the sheet product into the nip 229 of the dispensing mechanism 221, until the sheet product is positioned within the dispensing mechanism 221 and, later, the dispensing chute 213. In some embodiments, the loading device 233 may be configured to transition back to the receiving position when either a chute sensor 215 positioned within the dispensing chute 213 detects sheet product, or when the loading sensor 237 no longer detects sheet product.

FIGS. 13-14E illustrate another example embodiment of a loading device 733 which utilizes rotational movement to transition between a receiving position, a holding position, and a loading position. The loading device 733 may be attached to the chassis 740 of a sheet product dispenser 700 configured to dispense sheet product from a dispensing mechanism 721 down a chute 713, such as at predetermined increments, when the presence of a user is detected or when the user and/or maintainer engages with the control panel 795.

In some embodiments, the loading device 733 may comprise a nip blocker, for example a flap 757, and a nip roller 758 attached to and rotatable with a loading device body 756. In some embodiments, the nip blocker may be embossed, or otherwise printed on, to instruct the maintainer to insert the sheet product into the loading device body 756. The nip blocker may be configured to cover, or otherwise block the dispensing mechanism 721, thereby preventing dual loading of a new product roll and a stub roll into the dispensing mechanism 721. Although the nip blocker is illustrated as flap 757, in some embodiments, the nip blocker may be configured as a sliding mechanism, a hinging mechanism, or similar such that access to the dispensing mechanism 721 is blocked when loading sheet product into the loading device 733. Said differently, the nip blocker is configured to prevent loading of a leading end of a new roll of sheet product into the dispensing mechanism 721 and is configured to direct the leading end of the new roll into the loading device body 756, as will be discussed further herein.

FIGS. 14A-E illustrate the loading device 733 transitioning between the receiving position, holding position, and loading position. FIG. 14A illustrates the loading device 733 in a receiving position. When the loading device is in the receiving position, the flap 757 may be in an open configuration. The open configuration may cause the flap 757 to block the dispensing mechanism (e.g., 721 FIG. 13), including a drive roller 723 and a pinch roller 724, and thereby prevent sheet product from being positioned in the dispensing mechanism. In some embodiments, the flap 757 may be biased to the open configuration, such as by a spring or other biasing element. In this regard, the flap 757 may transition to a closed position (see e.g., FIG. 14C) when acted on by an opposing force.

In some embodiments, the chute 713 may include a chute sensor 715 configured to detect the presence of sheet product within the chute 713. When the chute sensor 715 detects sheet product, the loading device 733 may maintain either the receiving position or the holding position (see e.g., FIG. 14B).

In the receiving position, sheet product may be positioned through a channel opening 756*a* in the loading device body 756 and into a holding area 759. The holding area 759 may retain a leading end 731 of the sheet product 730 until the chute sensor 715 detects a lack of presence of sheet product in the chute 713.

In some embodiments, the holding area 759 may include a loading sensor 784 (e.g., an optical sensor) to detect when sheet product is present in the holding area 759. As illustrated in FIG. 14B, the loading device 733 may rotate to a holding position upon detection of the leading end 731 of the sheet product 730 within the holding area 759. In some embodiments, the holding position may pinch the leading end 731 of the sheet product 730 between a ledge 756*b* of the loading device body 756 and a wall 759*a* of the holding area 759. In some embodiments, the flap 757 may maintain the open configuration to block the dispensing mechanism while indicating to the maintainer there is sheet product 730 loaded into the loading device 733.

When the chute sensor 715 determines there is no sheet product within the chute 713, the loading device 733 may rotate in a first direction $D_1$ to transition from the holding position to the loading position. FIG. 14C illustrates the loading position and the sheet product 730 being loaded into the dispensing mechanism (the drive roller 723 and the pinch roller 724).

In the loading position, the loading device body 756 may be rotated such that the leading end 731 of the sheet product may be pulled through a loading device nip 756*c* formed between the flap 757 and the nip roller 758 towards a dispensing nip 729. As the loading device 733 rotated in the first direction $D_1$ the flap 757 may transition to a closed position, due to the interaction between the flap 757 and the drive roller 723. To explain, as the loading device 733 rotates in the first direction $D_1$, the flap 757 may transition to the closed position as the force between the drive roller 723 and the flap 757 may be greater than the biasing force which positions the flap 757 in the open configuration.

Rotating the loading device body 756 in the first direction $D_1$ pulls the leading end 731 of the sheet product 730 from the holding area 759 back through the loading device body 756 and into the loading device nip 765*c*. Thus, at the beginning of a new roll of sheet product there may be a dual layer of sheet product dispensed through the dispensing nip 729 and into the chute, however, the dual layer is limited in length. In some embodiments, in the loading position the flap 757 may block the holding area 759. The position of the flap 757 may prevent the sheet product from becoming stuck within the holding area 759, wrapped around the loading device body 756, or otherwise "jammed" as the sheet product is positioned within the loading device nip 756*c* rather than being pulled directly from the holding area 759 to the dispensing nip 729.

In the loading position, rotation of the nip roller 758 causes the leading end 731 of the sheet product 730 within the loading device body 756 to transition from the loading device body 756 to the dispensing nip 729 and into the chute 713.

After the leading end 731 is removed from the loading device body 756, such that the sheet product 730 is engaged in the dispensing nip 729 formed between the drive roller 723 and the pinch roller 724, as illustrated in FIG. 14D, the loading device 733 may rotate in a second direction $D_2$, back to the receiving position, illustrated in FIG. 14E. During the transition to the receiving position the flap 757 may return to the open configuration and the loading device 733 may be positioned to receive another roll of sheet product. In some embodiments, after rotation to the receiving position, the controller 795 may send an alert to notify a maintainer of the change in the sheet product roll. Alternatively, in some embodiments, the alert may be sent when the loading product sensor 784 detects a lack of sheet product within the holding area 759.

Example System Architecture

A schematic representation of components of an example sheet product dispenser system 300 according to various embodiments described herein is shown in FIG. 15.

It should also be appreciated that the illustration in FIG. 15 is for purposes of description and that the relative size and placement of the respective components may differ. The sheet product dispenser system 300, which includes a product dispenser 305 (e.g., a sheet product dispenser according to various embodiments described herein), includes components and systems that are utilized in various embodiments described herein.

The product dispenser 305 may include many different components and/or systems, including, for example, a controller 370, a dispensing mechanism 321, a dispensing mechanism motor 322, one or more rollers (e.g., a pinch roller 234, a drive roller 323, etc.), a memory 372, a communication interface 373, one or more user interfaces 371 (which may include one or more sensor(s) 379), a power system 376, one or more activation sensors 386, one or more product sensors 384, a loading device 333, a loading sensor 337, a motor 338, a nip blocker 349, a cover sensor 385, a chute sensor 315, a tear mechanism 380, and other sensor (s)/system(s) 375 such as described herein. Though shown in FIG. 15 as being a component of the product dispenser 305, such components are not required to be part of the product dispenser 305 according to various embodiments herein. For example, product dispensers of various embodiments described herein may include different components, but still function according to the desired embodiment. For example, some embodiments may include more or less product rolls 363, 365 and, in some cases, may include additional sets of components. Along these lines, the depicted embodiment of FIG. 15 is provided for explanatory purposes and is not meant to be limiting.

As will be described in more detail herein, the controller 370 provides logic and control functionality used during operation of the product dispenser 305. Alternatively, the functionality of the controller 370 may be distributed to several controllers that each provides more limited functionality to discrete portions of the operation of product dispenser 305.

The activation sensor(s) 386 may be configured to sense/receive user input (such as a user's hand or portion thereof) indicating a desire to cause the product dispenser 305 to dispense a portion of sheet product (e.g., from the product roll 363, 365). The activation sensor(s) 386 may be any type of sensor or feature capable of receiving user input to begin dispensing, including for example, a capacitive sensor, a light sensor, an infrared (IR) sensor, a mechanical lever or button, etc. The activation sensor(s) 386 may be in communication with the controller 370 such that the controller 370 can determine when to cause dispensing of the sheet product.

The dispensing mechanism 321 may be configured to cause dispensing of a portion of the sheet product, such as a portion (or length) of the currently loaded product roll. Depending on the configuration, the dispensing mechanism 321 may comprise a dispensing mechanism motor 322 that drives one or more rollers (e.g., a pinch roller 324 and a drive roller 323). In the dispensing mechanism 321, a portion of the product roll may be sandwiched (e.g., in frictional contact) between the drive roller 323 and the pinch roller 324 such that operation/rotation of the drive roller 323 causes dispensing of a portion of the product roll. The dispensing mechanism motor 322 may be in communication with the controller 370 such that the controller 370 may control operation of the motor 322.

A loading device 333 may be configured to receive a leading end of one of the first product roll 363 or the second product roll 365, such as described herein. As described herein, the loading device 333 may be configured to transition between at least three positions: a receiving position, a holding position, and nip loading position (such as via the motor 338). Accordingly, a maintainer may load the leading end of either product roll into the loading device 333, and the controller 370 may determine in which position the loading device 333 should transition to and cause the transition accordingly.

The loading device 333 may be in mechanical and/or electrical communication with the motor 338. The motor 338 may be configured to cause the loading device 333 to transition between a holding position, receiving position and/or nip loading position. The motor 338 may be in communication with the controller 370 such that the controller 370 may control operation of the motor 338. Although described herein as a motor 338, one of skill in the art would recognize other methods of rotating the loading device 333, such other types of drive mechanisms.

The loading device 333 and/or motor 338 may be in electrical communication with the loading sensor 337. The loading sensor 337 may be configured to sense sheet product within the loading device 333. The loading sensor 337 may be any type of sensor or feature capable of receiving user input to begin dispensing, including for example, a capacitive sensor, a light sensor, an IR sensor, a mechanical lever or button, etc. The loading sensor(s) 337 may be in communication with the controller 370 such that the controller 370 can determine when there is sheet product within the loading device 333.

The chute sensor 315 may be configured to sense sheet product within the chute. The chute sensor 315 may be any type of sensor or feature capable of determining whether sheet product is present in the chute, including for example, a capacitive sensor, a light sensor, an IR sensor, a mechanical lever or button, etc. The chute sensor 315 may be in communication with the controller 370 such that the controller 370 may receive data from the chute sensor 315 to determine when to cause the loading device 333 to transition to the nip loading position.

The nip blocker 349 may be in mechanical and/or electrical communication with the loading device 333 and/or the motor 338. The nip blocker 349 may be configured to move from a blocking position preventing loading of sheet product into the nip to an unblocking position when the loading device 333 transitions to the nip loading position. The nip blocker 349 may be in communication with the controller 370 such that the controller 370 may control operation of the nip blocker 349. In some embodiments, the nip blocker 349 may be a part of the loading device 333.

The cover sensor 385 may be configured to sense the position of the sheet product dispenser cover (e.g., in the closed position or the open position). The cover sensor 385 may be any type of sensor or feature capable of determining the position of the sheet product dispenser cover, including for example, a capacitive sensor, a light sensor, an IR sensor, a mechanical lever or button, etc. The cover sensor 385 may be in communication with the controller 370 such that the controller 370 may determine when to cause dispensing of the sheet product.

The product sensor (s) 384 may be configured to sense the amount of product remaining on the sheet product rolls (e.g., 363, 365). The product sensor(s) 384 may be any type of sensor or feature capable of determining the amount of sheet product remaining, including for example, a capacitive sensor, a light sensor, an IR sensor, a mechanical lever or button, etc. The product sensor(s) 384 may be in communication with the controller 370 such that the controller 370 may determine the amount of sheet product remaining.

A tear mechanism (e.g., a tear bar) 380 may be operable to aid in removal of the dispensed portion of sheet product. In some embodiments, such as described herein, the tear mechanism 380 may be movable between a first position and second position. A force provided by a user pulling on a dispensed portion of the sheet product may act against the tear mechanism 380 to tear the dispensed portion (e.g., utilizing teeth of the tear mechanism 180).

The controller 370 is a suitable electronic device capable of executing dispenser functionality via hardware and/or software control, with the preferred embodiment accepting data and instructions, executing the instructions to process the data, and presenting the results. Controller 370 may accept instructions through the user interface 371, or through other means such as, but not limited to, the activation sensor(s) 386, cover sensor 385, loading sensor 337, chute sensor 315, other sensors, voice activation means, manually-operable selection and control means, radiated wavelength and electronic or electrical transfer. Therefore, the controller 370 can be, but is not limited to, a microprocessor, microcomputer, a minicomputer, an optical computer, a board computer, a complex instruction set computer, an ASIC (application specific integrated circuit), a reduced instruction set computer, an analog computer, a digital computer, a molecular computer, a quantum computer, a cellular computer, a solid-state computer, a single-board computer, a buffered computer, a computer network, a desktop computer, a laptop computer, a personal digital assistant (PDA) or a hybrid of any of the foregoing.

The controller 370 may be operably coupled with one or more components of the product dispenser 305. Such operable coupling may include, but is not limited to, solid-core wiring, twisted pair wiring, coaxial cable, fiber optic cable, mechanical, wireless, radio, and infrared. Controller 370 may be configured to provide one or more operating signals to these components and to receive data from these components. Such communication can occur using a well-known computer communications protocol such as Inter-Integrated Circuit (I2C), Serial Peripheral Interface (SPI), System Management Bus (SMBus), Transmission Control Protocol/Internet Protocol (TCP/IP), RS-232, ModBus, or any other communications protocol suitable for the purposes disclosed herein.

The controller 370 may include one or more processors coupled to a memory device 372. Controller 370 may optionally be connected to one or more input/output (I/O) controllers or data interface devices (not shown). The memory 372 may be any form of memory such as an EPROM (Erasable Programmable Read Only Memory) chip, a flash memory chip, a disk drive, or the like. As such, the memory 372 may store various data, protocols, instructions, computer program code, operational parameters, etc. In this regard, controller 370 may include operation control methods embodied in application code. These methods are embodied in computer instructions written to be executed by one or more processors, typically in the form of software. The software can be encoded in any language, including, but not limited to, machine language, assembly language, VHDL (Verilog Hardware Description Language), VHSIC HDL (Very High Speed IC Hardware Description Language), Fortran (formula translation), C, C++, Visual C++, Java, ALGOL (algorithmic language), BASIC (beginners all-purpose symbolic instruction code), visual BASIC, ActiveX, HTML (HyperText Markup Language), and any combination or derivative of at least one of the foregoing.

Additionally, an operator can use an existing software application such as a spreadsheet or database and correlate various cells with the variables enumerated in the algorithms. Furthermore, the software can be independent of other software or dependent upon other software, such as in the form of integrated software.

In this regard, in some embodiments, the controller 370 may be configured to execute computer program code instructions to perform aspects of various embodiments of the present invention described herein. For example, as described in various example embodiments, the controller 370 may be configured to determine that user input is provided to a sensor 379 of the user interface 371 and cause operation of the associated function as well as operation of the motor to provide feedback to the user interacting with the sensor 379. Another example includes that the controller 370 may be configured to determine whether sheet product is present in the dispensing chute, via the chute sensor 315, and cause the loading device 333 to transition to the holding position if there is sheet product within the dispensing chute, or transition to the nip loading position if there is not sheet product within the dispensing chute.

The user interface 371 may be configured to provide information and/or indications to a user. In some embodiments, the user interface 371 may comprise one or more light emitting diodes (LEDs) to indicate such information (e.g., low battery, dispensing is occurring, low product amount, transfer complete, etc.). In some embodiments, the user interface 371 may include a screen to display such information. In some embodiments, the user interface 371 may be configured to receive user input such as through various sensors 379 (e.g., described herein) and/or other input devices (e.g., a keypad, touchscreen, physical buttons, etc.). The user interface 371 may be in communication with the controller 370 such that the controller 370 can operate the user interface 371 and/or receive instructions or information from the user interface 371.

One or more user input sensors 379 may, for example, be a part of the user interface 371 and may be configured to sense user input. Different sensors 379 may correspond to different functions (e.g., control settings, operations of the dispenser, etc.) such that interaction of a user (e.g., a maintainer) with the sensor may correspond to a desire for performance of the corresponding function. In some embodiments, the user input sensors 379 may be capacitive sensors that are configured to sense the presence of a user, such as described herein. However, other types of sensors are also contemplated. The sensors 379 may be in communication with the controller 370.

The communication interface 373 may be configured to enable connection to external systems (e.g., an external network 390). In this manner, the controller 370 may retrieve data and/or instructions from or transmit data and/or instructions to a remote, external server via the external network 390 in addition to or as an alternative to the memory 372.

In an example embodiment, the electrical energy (e.g., power 376) for operating the product dispenser 305 may be provided by one or more batteries, which may be comprised of one or more batteries arranged in series or in parallel to provide the desired energy. Additionally or alternatively, the power 376 may be supplied by an external power source, such as an alternating current ("AC") power source or a solar power source, or any other alternative power source as may be appropriate for an application.

The other sensor(s)/system(s) 375 may be any other type of sensors or systems that are usable in various embodiments of the present invention. Some example additional sensors or systems include a position sensor, a time sensor, among many others.

Example Flowchart(s)

Embodiments of the present invention provide methods, apparatuses and computer program products for controlling and operating an example product dispenser according to various embodiments described herein. Various examples of the operations performed in accordance with embodiments of the present invention will now be provided with reference to FIG. 16.

FIG. 16 illustrates a flowchart according to an example method for controlling and operating an example product dispenser according to an example embodiment 400. The operations illustrated in and described with respect to FIG. 16 may, for example, be performed by, with the assistance of, and/or under the control of one or more of various components, such as illustrated and described with respect to FIG. 15. Such example components include the controller 370, memory 372, communication interface 373, user interface 371, user interface sensor(s) 379, activation sensor(s) 386, dispensing mechanism 321, dispensing mechanism motor 322, chute sensor 315, loading device 333, motor 338, nip blocker 349, loading sensor 337, cover sensor 385, and/or other sensor(s)/system(s) 375 of the product dispenser 305.

Operation 402 may comprise determining if the leading end is positioned within the loading device. For example, the controller 370 may receive data from the loading sensor 337 indicating whether there is sheet product within the loading device. Alternatively, a cover sensor may indicate that the cover was just closed, which may correlate to an assumption that sheet product was loaded into the loading device.

Operation 404 may comprise determining if there is sheet product present in the dispensing chute. For example, the controller may receive data from the chute sensor (e.g., after a dispensing operation, at time increments, after the determination from operation 402, etc.) to indicate whether there is sheet product present in the dispensing chute.

If there is no sheet product present in the dispensing chute, the method 400 may move to operation 410 to cause the loading device to transition to the nip loading position to cause dispensing of sheet product from the leading end of the roll that was fed into the loading device.

If there is sheet product present in the dispensing chute, then the method 400 may move to operation 406, which comprises transitioning the loading device to the holding position. For example, the controller may determine there is sheet product in both the dispensing chute and the loading device by receiving data from the chute sensor and the loading sensor. Thus, as sheet product is present within the dispensing chute and the loading device, the loading device does not need to transfer the sheet product into dispensing mechanism.

Operation 408 may comprise determining if there is sheet product within the dispensing chute. For example, the controller may receive data from the chute sensor to indicate whether there is sheet product present in the dispensing chute. If there is sheet product present in the dispensing chute, the method may return to operation 406.

If there is no sheet product present in the dispensing chute, the method may move to operation 410 to cause transitioning of the loading device to the nip loading position to cause dispensing of sheet product from the leading end of the roll that was fed into the loading device.

Operation 412 may comprise transitioning the loading device back to the receiving position. For example, after the sheet product is within the dispensing mechanism and/or present within the dispensing chute, the loading device may transition back to the receiving position for easy loading of a next replacement roll.

In some embodiments, the example embodiment 400 may return to operation 402 to determine if there is a leading end positioned in the loading device. Thus, allowing the loading device to be ready to receive a leading end of the next roll of sheet product.

FIG. 14 illustrates an example flowchart of a system, method, and computer program product according to various example embodiments described herein. It will be understood that each block of the flowchart, and combinations of blocks in the flowchart, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by, for example, the memory 372 and executed by, for example, the controller 370. As will be appreciated, any such computer program product may be loaded onto a computer or other programmable apparatus, such that the computer program product including the instructions which execute on the computer or other programmable apparatus creates means for implementing the functions specified in the flowcharts block(s). Further, the computer program product may comprise one or more non-transitory computer-readable mediums on which the computer program instructions may be stored such that the one or more computer-readable memories can direct a computer or other programmable device to cause a series of operations to be performed on the computer or other programmable apparatus to produce a computer-implemented process such that the instructions which execute on the computer or other programmable apparatus implement the functions specified in the flowcharts block(s).

Associated systems and methods for manufacturing example product dispensers described herein are also contemplated by some embodiments of the present invention.

Conclusion

Many modifications and other embodiments of the inventions set forth herein may come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A sheet product dispenser for dispensing sheet product, the sheet product dispenser comprising:

a housing for holding a new roll of sheet product and a previously installed roll of sheet product;

a dispensing mechanism defining a nip for receiving sheet product from one of the new roll or the previously installed roll therethrough, wherein the dispensing mechanism is operable to dispense the sheet product from the one of the new roll or the previously installed roll to provide a dispensed portion of sheet product for retrieval by a user; and a loading device for receiving a leading end of the new roll of sheet product being installed into the housing, wherein the loading device is transitionable between a nip loading position, a receiving position, and a holding position, wherein, when in the receiving position, the loading device receives the leading end of the new roll of sheet product, wherein, when in the nip loading position, the loading device causes the leading end of the new roll of sheet product to enter the nip of the dispensing mechanism to cause the dispensing mechanism to begin dispensing sheet product from the new roll of sheet product, and wherein, when in the holding position, the loading device holds the leading end of the new roll of sheet product in a position away from the nip of the dispensing mechanism to prevent such dispensing mechanism from dispensing sheet product from the new roll of sheet product, wherein the loading device transitions between the nip loading position, the receiving position, and the holding position via rotation, wherein the loading device transitions from the receiving position to the nip loading position via rotation in a first rotational direction, and transitions from the receiving position to the holding position via rotation in a second rotational direction that is opposite to the first rotational direction.

2. The sheet product dispenser of claim 1 further comprising:

a sensor to sense whether or not sheet product is present in a dispensing chute that is positioned downstream of the nip; and a controller to determine, based on data from the sensor, whether the sheet product is present in the dispensing chute and either:

cause, if the sheet product is present in the dispensing chute, the loading device to transition to the holding position; or cause, if the sheet product is not present in the dispensing chute, the loading device to transition to the nip loading position.

3. The sheet product dispenser of claim 2, wherein the controller causes the loading device to transition back to the receiving position after the loading device has transitioned to the nip loading position.

4. The sheet product dispenser of claim 2 further comprising a loading sensor to sense when the leading end of the new roll of sheet product is received by the loading device, wherein the controller determines, based on data from the loading sensor, an instance in which the loading device has received the leading end of the new roll of sheet product and, in response, determines whether the sheet product is present in the dispensing chute and either:

cause, if the sheet product is present in the dispensing chute, the loading device to transition to the holding position; or cause, if the sheet product is not present in the dispensing chute, the loading device to transition to the nip loading position.

5. The sheet product dispenser of claim 2, wherein the housing includes a base portion and a cover, wherein the cover transitions between an open position and a closed position, wherein the sheet product dispenser further comprises a cover sensor configured to sense when the cover transitions to the closed position, wherein the controller determines, based on data from the cover sensor, that the cover transitions to the closed position and, in response, determines whether the sheet product is present in the dispensing chute and either:

cause, if the sheet product is present in the dispensing chute, the loading device to transition to the holding position; or cause, if the sheet product is not present in the dispensing chute, the loading device to transition to the nip loading position.

6. The sheet product dispenser of claim 1, wherein the loading device transitions between the nip loading position, the receiving position, and the holding position via linear motion.

7. The sheet product dispenser of claim 1, wherein the loading device defines a roller, and wherein the loading device receives the leading end through a slot within the roller.

8. The sheet product dispenser of claim 1, wherein the loading device comprises a body, a flap, and a nip roller, wherein the nip roller is attached to and rotatable with the body, wherein, in the receiving position, the flap and the nip roller are spaced apart, and wherein, in the nip loading position, the flap and the nip roller are adjacent so as to form a loading device nip that holds the leading end of the sheet product such that the leading end of the sheet product enters the nip of the dispensing mechanism.

9. The sheet product dispenser of claim 1, wherein, when in the holding position, the loading device pinches the leading end of the new sheet product roll against a surface to hold the leading end in place.

10. The sheet product dispenser of claim 1 further comprising a nip blocker that prevents loading of the leading end of the new roll of sheet product into the nip.

11. The sheet product dispenser of claim 10, wherein the nip blocker transitions to an unblocking position to enable the loading device to load the leading end of the new roll of sheet product into the nip when the loading device transitions to the nip loading position.

12. The sheet product dispenser of claim 1 further comprising a motor operable to transition the loading device between the nip loading position, the receiving position, and the holding position.

13. The sheet product dispenser of claim 12, wherein the dispensing mechanism includes a dispensing mechanism motor operable to cause rotation of a drive roller to cause dispensing of the sheet product, wherein the drive roller and a pinch roller form the nip of the dispensing mechanism.

14. A chassis for a sheet product dispenser for dispensing sheet product, wherein the sheet product dispenser includes a housing for holding a new roll of sheet product and a previously installed roll of sheet product, the chassis comprising:

a dispensing mechanism defining a nip for receiving sheet product from one of the new roll or the previously installed roll therethrough, wherein the dispensing mechanism is operable to dispense the sheet product from the one of the new roll or the previously installed roll to provide a dispensed portion of sheet product for retrieval by the user; and a loading device for receiving a leading end of the new roll of sheet product being installed into the housing, wherein the loading device is transitionable between a nip loading position, a receiving position, and a holding position, wherein, when in the receiving position, the loading device receives the leading end of the new roll of sheet product, wherein, when in the nip loading position, the loading device causes the leading end of the new roll of sheet product to enter the nip of the dispensing mechanism to cause the dispensing mechanism to begin dispensing sheet product from the new roll of sheet product, and wherein, when in the holding position, the loading device holds the leading end of the new roll of sheet product in a position away from the nip of the dispensing mechanism to prevent the dispensing mechanism from dispensing sheet product from the new roll of sheet product, wherein the loading device comprises a body, a flap, and a nip roller, wherein the nip roller is attached to and rotatable with the body, wherein, in the receiving position, the flap and the nip roller are spaced apart, and wherein, in the nip loading position, the flap and the nip roller are adjacent so as to form a loading device nip that holds the leading end of the sheet product such that the leading end of the sheet product enters the nip of the dispensing mechanism.

15. The chassis of claim 14, further comprising:

a sensor to sense whether or not sheet product is present in a dispensing chute that is positioned downstream of the nip; and a controller to determine, based on data from the sensor, whether the sheet product is present in the dispensing chute and either:

cause, if the sheet product is present in the dispensing chute, the loading device to transition to the holding position; or cause, if the sheet product is not present in the dispensing chute, the loading device to transition to the nip loading position.

16. The chassis of claim 14, wherein the loading device transitions between the nip loading position, the receiving position, and the holding position via rotation.

17. The chassis of claim 14, wherein the loading device transitions between the nip loading position, the receiving position, and the holding position via linear motion.

18. A method for controlling loading of a leading end of a new roll of sheet product into a nip of a dispensing mechanism of a sheet product dispenser, wherein the sheet product dispenser includes a housing that holds a new roll of sheet product and a previously installed roll of sheet product, the method comprising:

receiving sensor data from a sensor that senses whether or not sheet product is present in a dispensing chute that is positioned downstream of the nip;

determining, via a controller and based on data from the sensor, whether the sheet product is present in the dispensing chute; and either:

causing, if the sheet product is present in the dispensing chute, a loading device to transition to a holding position from a receiving position, wherein the loading device receives the leading end of the new roll of sheet product being installed into the housing, wherein the loading device is transitionable between a nip loading position, the receiving position, and the holding position, wherein, when in the receiving position, the loading device receives the leading end of the new roll of sheet product, wherein, when in the nip loading position, the loading device causes the leading end of the new roll of sheet product to enter the nip of the dispensing mechanism to cause the dispensing mechanism to begin dispensing sheet product from the new roll of sheet product, and wherein, when in the holding position, the loading device holds the leading end of the new roll of sheet product in a position away from the nip of the dispensing mechanism to prevent the dispensing mechanism from dispensing sheet product from the new roll of sheet product; or causing, if the sheet product is not present in the dispensing chute, the loading device to transition to the nip loading position, wherein the loading device transitions between the nip loading position, the receiving position, and the holding position via rotation, wherein the loading device transitions from the receiving position to the nip loading position via rotation in a first rotational direction, and transitions from the receiving position to the holding position via rotation in a second rotational direction that is opposite to the first rotational direction.

19. The method of claim 18 further comprising causing the loading device to transition back to the receiving position after the loading device has transitioned to the nip loading position.

20. The method of claim 18, wherein the sheet product dispenser further comprises a loading sensor for sensing when the leading end of the new roll of sheet product is received by the loading device, the method further comprising:

determining, based on data from the loading sensor, that the leading end is received by the loading device and, in response, determining whether the sheet product is present in the dispensing chute and either:

causing, if the sheet product is present in the dispensing chute, the loading device to transition to the holding position; or causing, if the sheet product is not present in the dispensing chute, the loading device to transition to the nip loading position.

21. The method of claim 18, wherein the housing includes a base portion and a cover, wherein the cover is transitionable between an open position and a closed position, wherein the sheet product dispenser further comprises a cover sensor for sensing when the cover transitions to the closed position, the method further comprising:

determining, based on data from the cover sensor, that the cover transitions to the closed position and, in response, determining whether the sheet product is present in the dispensing chute and either:

causing, if the sheet product is present in the dispensing chute, the loading device to transition to the holding position; or causing, if the sheet product is not present in the dispensing chute, the loading device to transition to the nip loading position.

22. A sheet product dispenser for dispensing sheet product, the sheet product dispenser comprising:

a housing for holding a new roll of sheet product and a previously installed roll of sheet product;

a dispensing mechanism defining a nip that receives sheet product from one of the new roll or the previously installed roll therethrough, wherein the dispensing mechanism is operable to dispense the sheet product from the one of the new roll or the previously installed roll to provide a dispensed portion of sheet product for retrieval by a user;

a loading device for receiving a leading end of the new roll of sheet product being installed into the housing, wherein the loading device is transitionable between a nip loading position and a receiving position; and a nip blocker that extends from the loading device to cover the nip to prevent loading of the leading end of the new roll of sheet product into the nip, wherein, when in the receiving position, the loading device receives the leading end of the new roll of sheet product, and wherein, when in the nip loading position, the loading device causes the leading end of the new roll of sheet product to enter the nip of the dispensing mechanism to cause the dispensing mechanism to begin dispensing sheet product from the new roll of sheet product.

23. The sheet product dispenser of claim 22, wherein the nip blocker is a flap that extends from the loading device to cover the nip.

24. The sheet product dispenser of claim 23, wherein the loading device is a roller and the flap extends from the roller and transitions from a blocked position to an unblocked position via rotation of the roller.

* * * * *